US006908214B2

(12) United States Patent
Luk

(10) Patent No.: US 6,908,214 B2
(45) **Date of Patent: *Jun. 21, 2005**

(54) VARIABLE BEAM LED LIGHT SOURCE SYSTEM

(75) Inventor: John F. Luk, Flushing, NY (US)

(73) Assignee: Altman Stage Lighting Co., Inc., Yonkers, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/400,405

(22) Filed: Mar. 27, 2003

(65) Prior Publication Data

US 2003/0193802 A1 Oct. 16, 2003

Related U.S. Application Data

(63) Continuation-in-part of application No. 09/815,321, filed on Mar. 22, 2001, now Pat. No. 6,585,395.

(51) Int. Cl.[7] ..... F21Y 21/14

(52) U.S. Cl. ..... 362/250; 362/239; 362/240; 362/372; 362/418

(58) Field of Search ..... 362/3, 11, 16, 362/18, 145, 147, 148, 227, 230, 231, 233, 235–240, 249, 250, 257, 277, 278, 280, 281–287, 296, 362, 372, 382, 418, 800, 399; 315/76, 291, 293, 294, 297, 307, 308

(56) References Cited

U.S. PATENT DOCUMENTS 4,388,567 A * 6/1983 Yamazaki et al. ..... 315/291
4,392,187 A * 7/1983 Bornhorst ..... 362/233
4,716,344 A * 12/1987 Newell et al. ..... 315/312
4,855,884 A * 8/1989 Richardson ..... 362/278
5,146,153 A * 9/1992 Luchaco et al. ..... 323/324
5,580,163 A * 12/1996 Johnson, II ..... 362/285
5,691,604 A * 11/1997 Viljanen ..... 315/291
5,752,766 A * 5/1998 Bailey et al. ..... 362/250
6,149,283 A * 11/2000 Conway et al. ..... 362/236
6,331,756 B1 12/2001 Belliveau
6,331,813 B1 12/2001 Belliveau
6,390,643 B1 * 5/2002 Knight ..... 362/250
6,459,217 B1 10/2002 Belliveau
6,548,967 B1 4/2003 Dowling et al.
6,585,395 B2 * 7/2003 Luk ..... 362/250

* cited by examiner

*Primary Examiner*—John Anthony Ward
*Assistant Examiner*—Ismael Negron
(74) *Attorney, Agent, or Firm*—Myron Greenspan, Esq.; Lackenbach Siegel LLP

(57) ABSTRACT

A diode light source system for stage, theatrical and architectural lighting has numerous separate flat, rigid panels for mounting light emitting diodes that emit diode light beams to a common focal area. Each panel is mounted with a group of these diodes, and each has an outer and an inner panel. A screw arrangement selectively positions the panels, with each panel oriented at a selected angle relative to an axis, and with each group of diodes emitting diode light beams transverse to each separate panel. Each inner panel portion is flexibly secured to the screw arrangement. The panels function hold the diodes and act as electrical circuit boards to transmit direct electrical current to the diodes on the panels. The screw arrangement includes an elongated, externally threaded cylinder, with opposed inner and outer ends, rotatably aligned with the axis and mounted on a corresponding internally cylindrical threaded nut.

63 Claims, 18 Drawing Sheets

VARIABLE BEAM LED LIGHT SOURCE SYSTEM

CROSS REFERENCE TO RELATED APPLICATION

This application is a continuation-in-part (CIP) application of U.S. patent application Ser. No. 09/815,321 filed Mar. 22, 2001 now U.S. Pat. No. 6,585,395, (published as 2002 0136010).

BACKGROUND OF THE INVENTION

1. Field of the Invention

The present invention generally relates to illumination for theatrical, architectural and stage lighting systems, and, more particularly, to variable beam LED color changing luminaries.

2. Description of the Prior Art

Longer life and more energy efficient sources of light have become increasingly important thus making alternative light sources important. Recent advances in light emitting diode (LED) technology particularly the development of multi-chip and multi-LED arrays have led to brighter LEDs available in different colors. LEDs are available in both visible colors and infrared. In addition to red, yellow, green, and amber-orange, which were the first available colors, LEDs are now available in blue and even white light. LEDs operate at lower currents and yet produce 100 percent color intensity and light energy. For many applications, LEDs can compete directly with incandescent filament light sources.

LEDs emit a focused beam of color light in a variety of different angles, in contrast to incandescent filament lamps, which emit only the full spectrum of light. In order to obtain color from an incandescent filament lamp, a specific color gel or filter in the desired color spectrum must be used. Such a system results in 90 percent or more of the light energy wasted by the incandescent filament lamp. LEDs on the other hand deliver 100 percent of their energy as light and so produce a more intense colored light. White light is also produced more advantageously by LEDs. White light is obtained from LEDs in two ways: first, by using special white light LEDs; and second, by using an additive mixture of red, green and blue (RGB) LEDs at the same intensity level so as to produce a white light. With regard to the second method, variable intensity combinations of RGB LEDs will give the full color spectrum with 100 percent color intensity and light output energy. The primary colors red, green, and blue of RGB LEDs can be mixed to produce the secondary colors cyan, yellow, magenta (CYM) and also white light. Mixing green and blue gives cyan, as is known in the art of colors. Likewise as is known in the art, mixing green and red gives yellow. Mixing red and blue gives magenta. Mixing red, green, and blue together results in white. Advances in light-emitting diode technology include the development of multi-chip and multi-LED arrays, which have led to brighter LEDs available in different colors. LEDs are available in both visible colors and infrared.

LEDs are more energy efficient as well. They use only a fraction of the power required by conventional incandescent filament lamps. The solid state design of LEDs results in great durability and robustness to withstand shock, vibration, frequent power cycling, and extreme temperatures. LEDs have a typical 100,000 hours or more usable life when they are operated within their electrical specifications. Incandescent filament lamps are capable of generating high-intensity light for only a relatively short period of time and in addition are very susceptible to damage from both shock and vibration.

Incandescent filament lamps of the MR and PAR type are the best known and most widely used technologies of the architectural, theatrical and stage lighting industry. Such lamps are available in different beam angles, producing beam angles ranging from narrow spot lights to wide flood focuses. Such types of lamps are very popular because they have long-rated lives up to 5,000 hours.

Light emitting diode LED technology including white light and full color red, green, blue (RGB) tile array modules have become common in certain areas of illumination, most commonly for large scale lighted billboard displays. Such LED light sources incorporate sturdy, fast-moving and animated graphics with full color. Such flat displays offer only one fixed viewing angle, usually at 100 degrees.

Another use of fixed flat panels for LED arrays are currently used in traffic lights and for stop lights and warning hazard lights mounted on the rear of automobiles.

A recent advance in LED lamp technology has been ICOLOR MR electronic controllers introduced by Color Kinetics Inc. The ICOLOR MR electronic controller is a digital color-changing lamp, which plugs into standard MR 16 type lighting fixtures. This lamp has the advantage of using variable intensity colored LEDS with a long-life of 100,000 hours or more. On the other hand, it has a fixed LED array that is limited to a fixed beam angle of 22 degrees (SPOT). Similarly, Boca Flashes, Inc. offers a compact LED array of up to 24 LEDS in a typical dicbroic coated glass reflector. The beam angle is limited to 20 degrees.

Another LED light source is use today takes the form of a flashing warning beacon. The LEDs are arranged in a cylindrical array around the circumference of a tube base. This configuration allows for viewing from a 360 degree angle. The same configuration is also used in wedge base type LED lamps as well as in LED bulbs mounted on a standard screw base.

MR and PAR type incandescent filament lamps are able to be controlled to produce complete control of output beam angles. MR and PAR lamps are fixed focus and are not adapted to control beam angles. LED technology to date does not offer complete control of output beam angles.

Some patents that have addressed this problem are as follows:

1) U.S. Pat. No. 5,752,766 issued to Bailey et al. on May 19, 1998, discloses a focusable lighting apparatus for illuminating area for visual display. A flexible base member, shown as a cylindrical flexible base or support member 20 in FIG. 2, is supported on a housing and an array of LEDs are supported on the flexible base. An actuator connected to the flexible base is operable to move the flexible base to selected working positions so as to direct LED generated light beams normally, inwardly or outwardly. The LEDs are supported on the flexible base 20. Flexible base 20 can be deflected (see page 3, lines 45–49 and also page 4, lines 43–46) so that the optical axes 39*a* in a parallel mode to provide converging light beams indicated by lines 39*b* in FIG. 2. The bending of flexible base 20 is accomplished by actuator 28 by way of a rod 26 with a second flexed position shown in phantom line in FIG. 2. It is apparent that the range of beam angles that can be achieved by pulling or pushing flexible base 20 is limited by the unitary structure of flexible base 20. Flexible base 20 itself is described as flexible so that stretching of the flexible base 20 itself is necessary to change the diode beam angles. The material composition of flexible base 20 is described as being made of any of various polymer or elastomer materials (page 4, lines 51–62). The unitary structure of flexible base 20 creates a built-in limitation position (page 4, lines 53–62. The invention described therein has a limitation to its usefulness in the field of stage and theatrical lighting. It is also noted that the limited strength of flexible base 20 itself to maintain constant diode beam angles is compromised so that the beam angles are significantly misdirected since the diodes 22 cannot maintain constant angles relative to the plane of flexible base 20 because flexible base 20 itself undergoes a warping effect and so maintains no constant plane angle except in the parallel beam mode. Also, the number of diodes 22 that can be mounted to flexible base 20 is limited by the "relatively thin" (page 2, line 59) flexible base 20. Also, permanent molding of the light emitting elements seems necessary, which indicates a difficulty in replacing the elements when they fail.

2) U.S. Pat. No. 5,580,163 issued to Johnson on Dec. 3, 1996, discloses a plurality of light emitting elements including light bulbs and LEDs attached to a circular flexible membrane that in turn is connected to outer and inner housing that are movable relative to one another so as to flex the membrane in a predetermined manner. The inner housing is threaded into an adjusting nut that can be rotated to move the inner housing relative to the outer housing. The light emitting elements are correspondingly moved so that their collective light beams are selectively focused at a common area. In this invention, the mounting of the light emitting elements is restricted to a circular membrane. It is apparent that the number of light emitting elements are restricted. FIG. 6 of the invention shows an increased number of light emitting elements but again this view emphasizes the limitation of lighting elements available on this device. The number of elements is limited primarily by the fact that the flexible membrane can support a restricted number of light emitting elements just as a weight bearing problem. It is further noted that because of the flexibility of the membrane holding the light emitting elements, each element will to some degree be significantly misdirected because of the warping effect of the flexible membrane as it is moved between positions. Also permanent molding of the light emitting elements are discussed, which indicates a difficulty in replacing the elements when they fail.

3) U.S. Pat. No. 5,101,326 issued to Roney on Mar. 31, 1992, discloses a lamp for a motor vehicle that discloses a plurality of light emitting diodes positioned in sockets that direct the diode generated light beams in overlapping relationship so as to meet photometric requirements set forth by law. The diodes are not selectively movable to different focal areas.

4) U.S. Pat. No. 5,084,804 issued to Schaier on Jan. 28, 1992, discloses a wide area lamp comprising a plurality of diodes mounted on a single flexible connecting path structure than can be moved to a number of shapes as required. The diodes of the disclosed lamp are not collectively and selectively adjustable in a uniform manner for being directed to a common focal area.

Luminaires that include a fixed light source are often used in combination with a specially designed front lens designed to provide optical characteristics that allow for different beam angle spreads. This is true for conventional filament and arc lamp type luminaires, as well as with some existing LED luminaires.

Such beam spreads include narrow spot, spot, medium spot, wide spot, narrow flood, flood, medium flood, wide flood, and very wide flood. Because there are so many possible combinations of lenses with the one luminaire, it because awkward and cumbersome to have to change the front lens every time a new beam spread is desired. An end-user would have to stock a variety of different spread lenses in order to have the one luminaire achieve any beam spread at any given time. The inventory of lenses and the manual labor of having to change out the lenses would be still greater when groups of luminaires are used.

The same inventory and time consumption program also occurs when an end-user wants a different color beam to be projected from the luminaire, more so for conventional filament and arc lamp type luminaires than with LED color changing luminaires. To achieve the different color beam outputs for conventional luminaires, a plastic color gel medium or colored glass lens is placed in front of the light source.

Based on the above, a lighting system consisting of multiple variable beam color changing LED light source luminaires becomes desirable. U.S. Pat. No. 4,962,687 for a variable color lighting system also teaches color changing LED light sources. And U.S. Pat. Nos. 6,016,038 and 6,150,774, both for multicolored LED lighting method and apparatus, disclose color control of LEDs.

Digital communications between a remote controller and color changing LED luminaires are known and are typically performed by cable wires including parallel or serial bus, in series wiring, star network wiring, parallel wiring, FDDI ring network wiring, token ring network wiring, etc. Other forms of wired communications control includes the DMX512 protocol, x10 and the CEBus (Consumer Electronics Bus) standard EIA-600 for communications over a power line. Wireless communication control can also be used with color changing LED lighting systems, including FCC approved RF Radio Frequency and IR Infrared control protocols.

Remote control of luminaires are disclosed in U.S. Pat. No. 6,331,756 for a method and apparatus for digital communications with multiparameter light fixtures; U.S. Pat. No. 6,331,813 for multiparameter device control apparatus and method; U.S. Pat. No. 6,357,893 for lighting devices using a plurality of light sources; and U.S. Pat. No. 6,459,217 for method and apparatus for digital communications with multiparameter light fixtures. These patents are incorporated herein by reference.

SUMMARY OF THE INVENTION

It is an object of the present invention to provide a lighting system that is capable of providing a plurality of selected different light beam angles from a single LED lighting system source;

It is a further object of the present invention to provide a lighting system that is capable of selectively varying the common directional angles of a plurality of individual LED arrays arranged around a common central axis;

It is a further object of the present invention to provide a lighting system that is capable of simultaneously and selectively moving a plurality of individual LED arrays about a common central axis to as to collectively arrange the totality of LED light beams arranged on individual arrays in a plurality of directional modes including a normal parallel mode of all of the LED generated light beams, a selected converging mode of all of the LED generated light beams, and a selected diverging mode of all of the LED generated light beams.

In accordance with the above objects and others that will be disclosed in the course of the disclosure of the present invention, there is provided a diode light source system for stage, theatrical and architectural lighting that includes a plurality of separate flat panels for mounting a plurality of light emitting diodes that emit a plurality of diode light beams to a common focus area, each separate panel being mounted with a plurality of grouped diodes of the plurality of diodes, each separate panel having an outer panel portion and an inner panel portion. A housing containing the panels has a center base portion and a circular rim defining a housing aperture aligned with a circular rim plane having a rim plane center that is arranged transverse to an axis aligned with the center base portion. A first connecting means flexibly secures each outer diode panel portion to the housing rim. A screw arrangement positions the panels at a plurality of selected positions wherein each of the panels is oriented at a selected angle relative to the axis and each of the grouped diodes emit diode light beams transverse to each separate panel. A second connecting means flexibly secures each inner panel portion to the screw arrangement. The panels are flat and rigid and have both the function of holding the diodes and of being electrical circuit boards for transmitting direct electrical current to the diodes grouped on each separate panel. The screw arrangement comprises an elongated externally threaded cylinder and a correspondingly internally threaded cylindrical nut, the externally threaded cylinder, which is rotatable about the axis, being threadably mounted within the cylindrical nut. The externally threaded cylinder has the circular rim plane. The first and second flexible connecting means can each be either a biasable or flexible member or a biasable spring.

A variable beam color changing LED lighting system is disclosed, in which digital data communications link each luminaire in the system to a remote controller. Integral or separate power communications link each luminaire in the system to a remote controller separately or can be included as a single power communications link linking each luminaire in the system to a remote controller.

Current control means will be located within each luminaire to control RGB color LED intensity and motor means coupled to a centrally located actuator to move the LED-mounting panels. A separate current drive signal is provided for each color and for the beam focus. Methods of controlling the current in the LEDS besides DC voltage include PWM and PAM.

The luminaires can communicate with an external and remote controller console or can operate independently as a stand-alone luminaire that can execute internal programs.

The present invention will be better understood and the objects and important features, other than those specifically set forth above, will become apparent when consideration is given to the following details and description, which when taken in conjunction with the annexed drawings, describes, illustrates, and shows preferred embodiments or modifications of the present invention and what is presently considered and believed to be the best mode of practice in the principles thereof.

Other embodiments or modifications may be suggested to those having the benefit of the teachings therein, and such other embodiments or modifications are intended to be reserved especially as they fall within the scope and spirit of the subjoined claims.

DETAILED DESCRIPTION OF THE PREFERRED EMBODIMENTS

Figure 1:
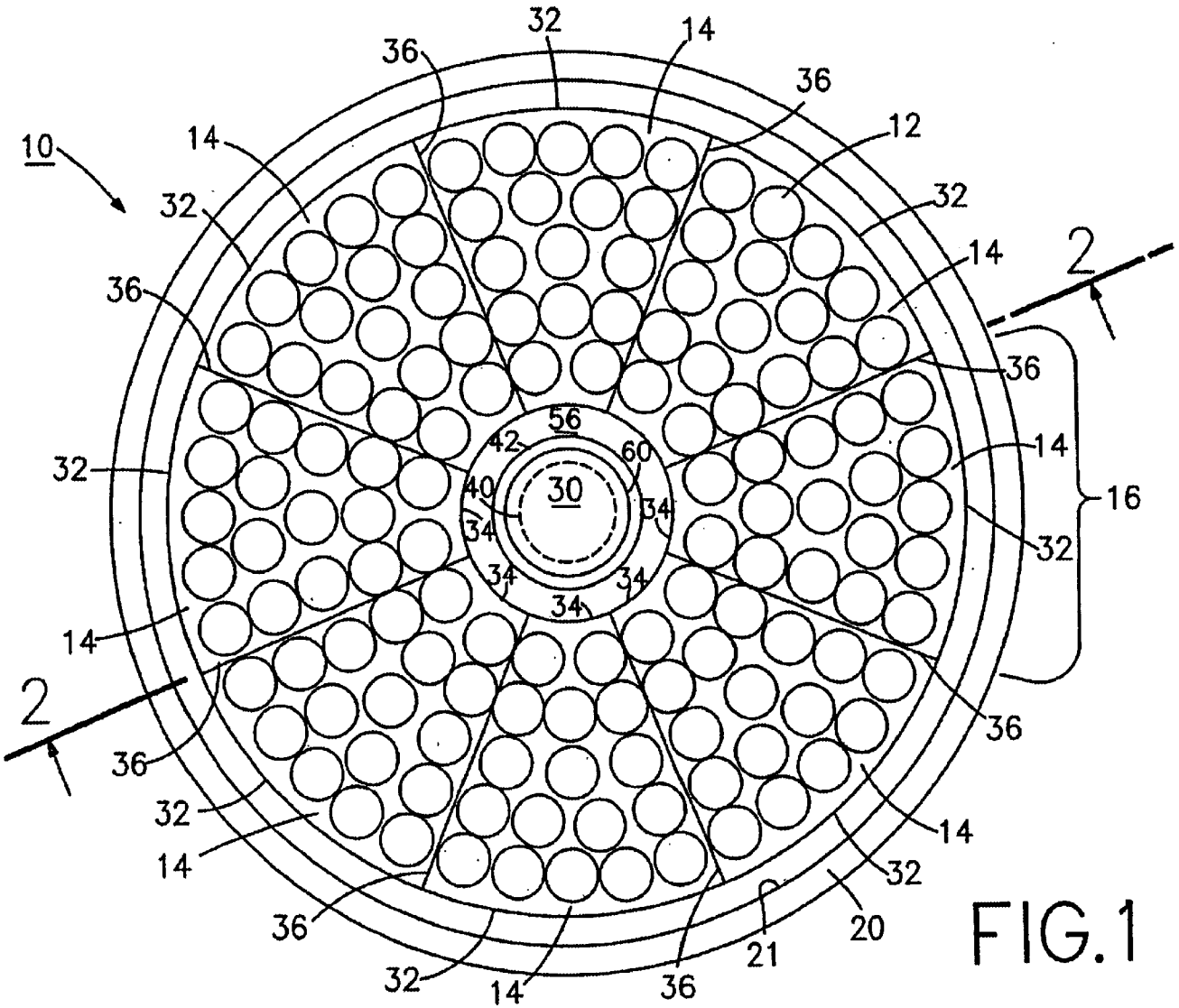
FIG. 1 is a frontal view of the variable beam lighting system that shows a plurality of diodes mounted on eight wedge-shaped mounting/circuit board diode panels in the normal, or parallel beam, mode of the diodes.

Reference is now made to the drawings and in particular to FIGS. 1–16 in which identical or similar parts are designated by the same reference numerals throughout.

Figure 2:
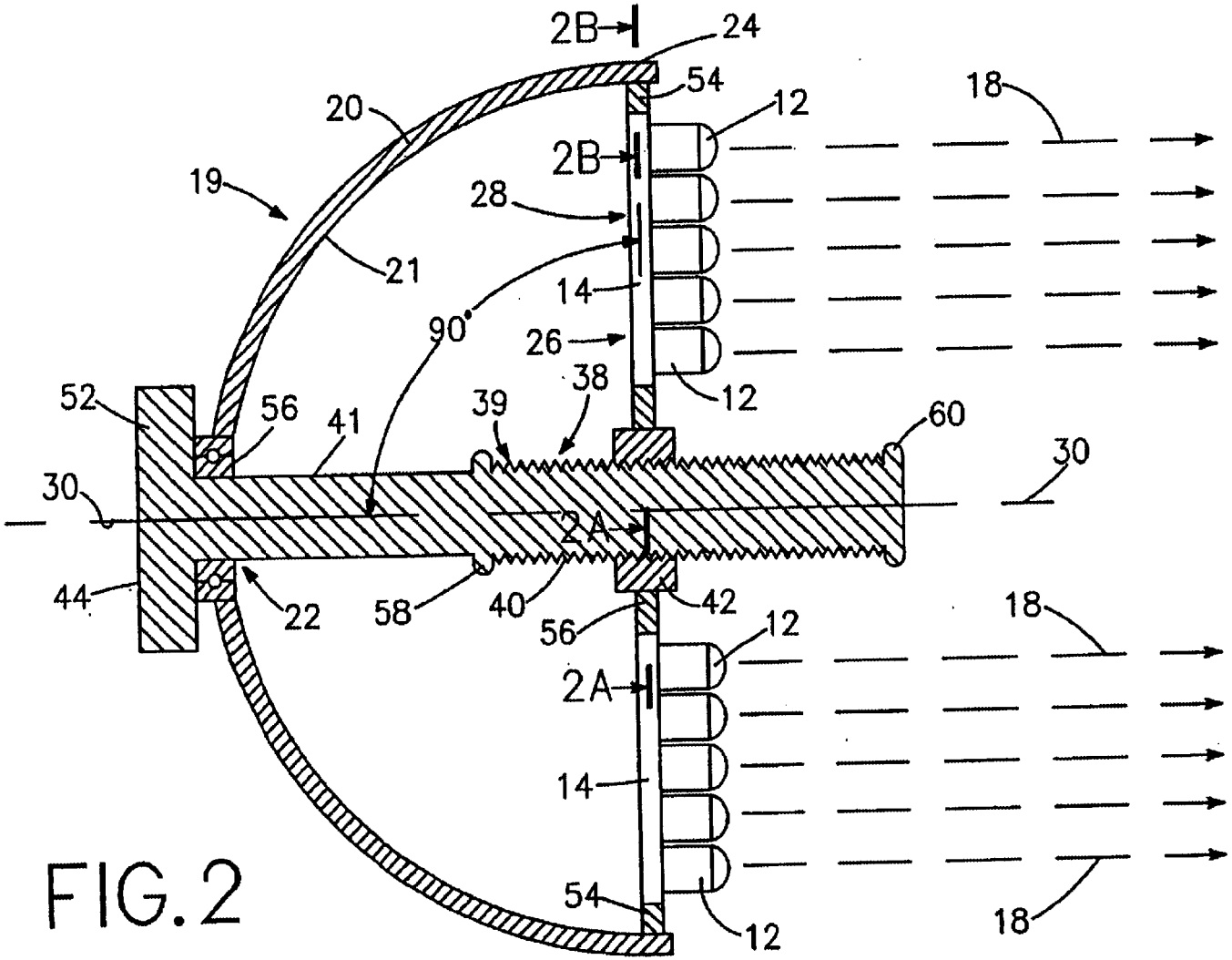
FIG. 2 is a side center sectional view of a outer flexible hinge area of the panels taken through line 2—2 of FIG. 1.

A light source system 10 for stage, theatrical and architectural lighting as shown in FIGS. 1–6 includes a plurality of light emitting diodes (LEDs) 12, referred to as diodes herein, that are mounted on eight separate flat diode panels 14 so as to emit diode light beams 18 towards a common focus area as seen in one directional mode in FIG. 2. The number of diode panels 14 are shown as eight for purposes of exposition only and can vary in number. A panel diode group 16 includes seventeen diodes 12 per diode panel 14 for a total of 136 diodes 12 for the total array of diodes 12 for light source system 10. The number of diodes 12 per diode panel 14 is shown as seventeen for purposes of exposition only and can vary. Each diode group 16 emits a common group of seventeen diode light beams 18 in parallel relationship.

FIG. 2 shows a housing 19 for containing and holding diode panels 14 and diodes 12. Housing 19 defines a concave hollow volume shown as semi-spherical in configuration for purposes of exposition but the configuration of housing 19 is preferably of any regular configuration such as semi-ellipsoidal, cone-shaped, and parabolic. Housing 19 has a housing wall 20 preferably having an arced microreflective inner surface 21. Housing 19 has a center base portion 22 and a circular housing rim 24 that in turn defines a circular aperture 26 that lies in a housing rim aperture plane 28. The center of circular aperture 26 is in an axial alignment indicated in FIG. 3 as housing axis 30 with center base portion 22. Each separate diode panel 14 is configured as a wedge with a panel outer arc edge 32 and a panel inner arc edge 34 and panel linear side edges 36 that taper inwardly from panel outer arc edge 32 to panel inner arc edge 34. All diode panels 14 are movable between adjacent panel relationships and separated panel relationships.

A beam direction selection screw mechanism or arrangement 38 positions each diode panel 14 between a plurality of selected positions relative to housing axis 30 wherein each diode panel 14 is oriented at a predetermined angle relative to housing axis 30. As a result, each panel diode group 16 emits diode light beams 18 at a beam angle transverse to the predetermined angle of panels 14. Screw arrangement 38 is secured to housing 19 and to each diode panel 14 at panel inner arc edge 34.

Screw arrangement 38 comprises an elongated externally spirally threaded solid cylinder 39 that includes a threaded portion 40 and an unthreaded portion 41, which extends between threaded portion 40, and center base portion 22 and a correspondingly internally threaded cylindrical nut 42 Externally threaded solid cylinder 39 is threadably mounted within cylindrical nut 42. Externally threaded solid cylinder 39 is rotatably aligned with housing axis 30 of housing 19 and extends external to housing rim aperture plane 28.

Externally threaded cylinder 39 has opposed inner and outer end portions 44 and 46, respectively. Inner end portion 44 is rotatably mounted to housing 19 at center base portion 22. Outer end portion 46 is positioned spaced from housing rim aperture plane 28. Internally threaded cylinder nut 42 has a cylindrical outer surface 48. Center base portion 22 defines an aperture wherein is mounted bearings 50 through which externally threaded solid cylinder 39 extends external to housing 19. A handwheel 52 is mounted to externally threaded solid cylinder 39 external to housing 19.

A flexible and biasable cylindrical outer connecting ring 54 has an arced outer edge that is connected to an arced microreflective inner surface 21 of housing wall 20 at the circular inner side of the circular housing rim 24 by a means known in the art. Housing 19 and outer connecting ring 54 are preferably made of plastic and can be connected one to the other by a means known in the art such as by heat fusing. Alternatively, fixing pins (not shown) can be extended through wall surface 21 and a flap (not shown) of connecting ring 54. Outer connecting ring 54 further has an arced inner edge that is connected to panel outer arc edge 32 in a manner know in the art, for example, by fixing pins. A flexible and biasable cylindrical inner connecting ring 56 has an arced outer edge that is connected to panel inner arc edge 34 by a means known in the art, for example, by fixing pins. Cylindrical inner connecting ring 56 has an arced inner edge that is connected to the cylindrical wall of nut 42 by a means known in the art. For example, nut 42 is preferably made of a rigid plastic material and inner connecting member is likewise of plastic so that nut 42 and inner connecting ring 56 can be heat fused.

Figure 2B:
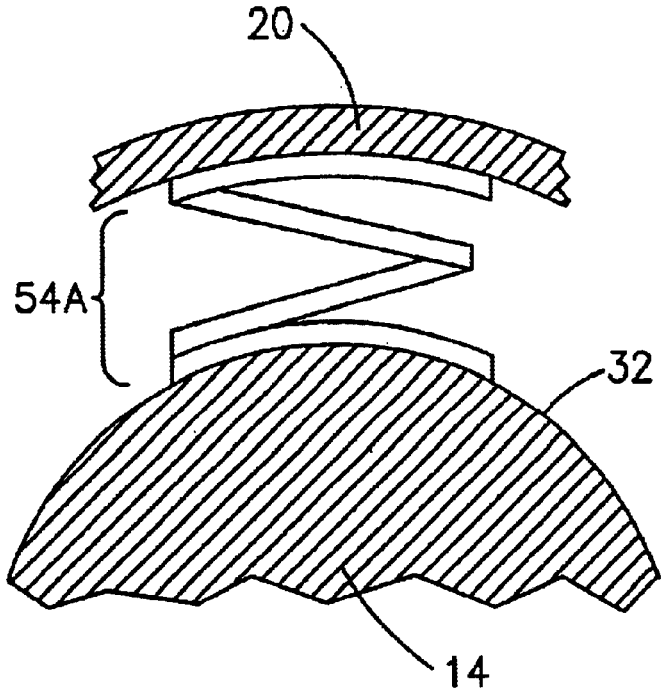
FIG. 2B is a sectional view taken though line 2B—2B of FIG. 2.
Figure 2A:
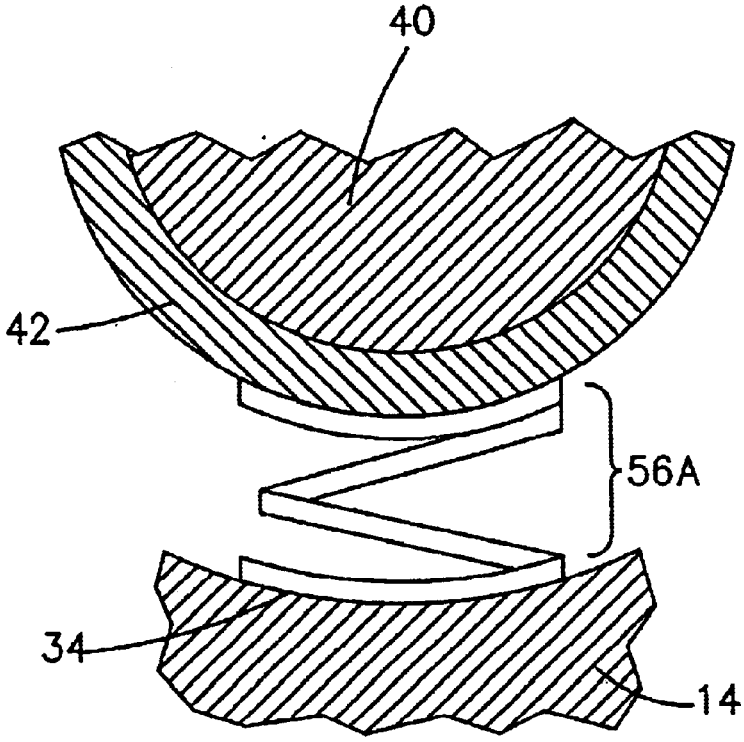
FIG. 2A is a sectional view of the flexible inner flexible hinge area of the diode panels taken through line 2A—2A of FIG. 2.

FIG. 2A shows an alternate flexible connecting ring 54A that secures inner panel arc edge 34 to connecting nut 42 wherein connecting ring 54A is creased to stretch and to compress by unfolding and folding, respectively, in the manner of an accordion or bellows between a normal folded mode as shown in FIG. 2A and an expanded mode (not shown).

FIG. 2B shows an alternate flexible connecting ring 56A that secures outer panel arc edge 32 to the circular housing rim 24 wherein connecting ring 556A is creased to stretch and to compress by unfolding and folding, respectively, in the manner of an accordion between a normal folded mode as shown in FIG. 2B and an expanded mode (not shown).

Screw arrangement 38 is operable by rotation of handwheel 52 at inner end portion 44 in either a clockwise or a counterclockwise direction. When handwheel 52 is rotated in the clockwise direction when diode panels 14 are in the position shown in FIG. 2, wherein diode panels 14 lie in housing rim aperture plane 28 as shown in FIG. 2, and externally threaded solid cylinder 39 rotates clockwise relative to cylindrical nut 42 wherein panel linear side edges 36 are drawn inwardly, or apart. Continued counterclockwise rotation can continue until cylindrical nut 42 is restrained by an internal cylindrical stop 58 connected to externally threaded cylinder 39, a position shown in FIG. 4. Internal stop 58 is positioned spaced from center base portion 22. When handwheel 52 is rotated in the clockwise direction from the position shown in FIG. 2, externally threaded solid cylinder 40 rotates clockwise relative to cylindrical nut 42 wherein panel linear side edges 36 are pushed outwardly, or apart. Continued counterclockwise rotation can continue until cylindrical nut 42 is retrained by an external cylindrical stop 60 positioned at outer end portion 46 of externally threaded cylinder 40, a position shown in FIG. 5.

FIGS. 1 and 2 show all diode panels 14 in a selected position wherein diode panels 14 are aligned with housing rim aperture plane 28 wherein diode panels 14 are aligned with housing rim aperture plane 28 and also are aligned at a 90 degree angle relative to housing axis 30 and to threaded cylinder 40. In this selected position diode light beams 18 of all diode panels 14 are oriented in parallel relative to housing axis 30 wherein the diode beam angle is in a normal beam mode towards a common focus area.

Figure 3:
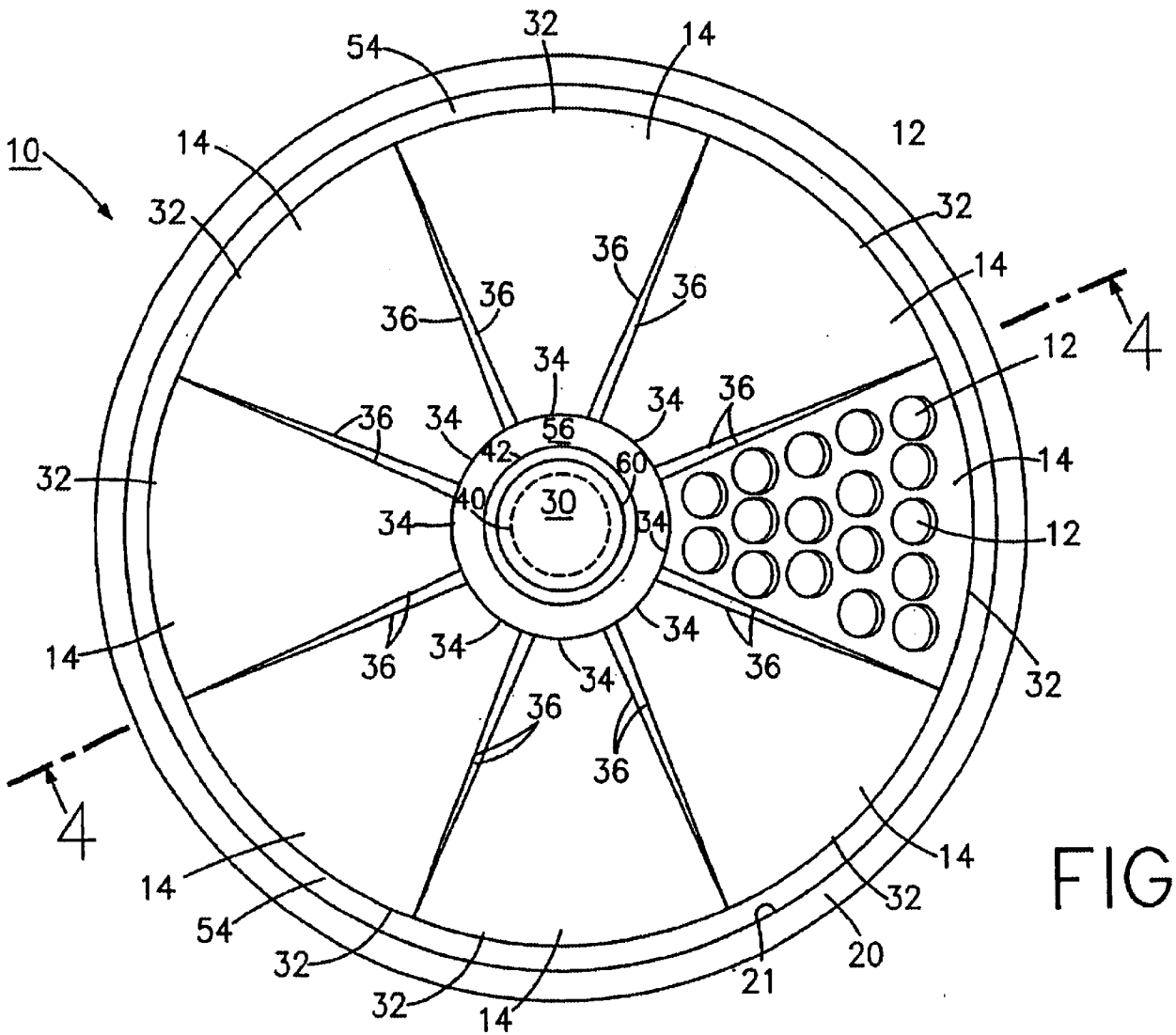
FIG. 3 is a frontal view of the lighting system as shown in FIG. 1 with the eight diode panels in a full forward mode with one diode panel shown mounted with diodes for purposes of convenience.
Figure 4:
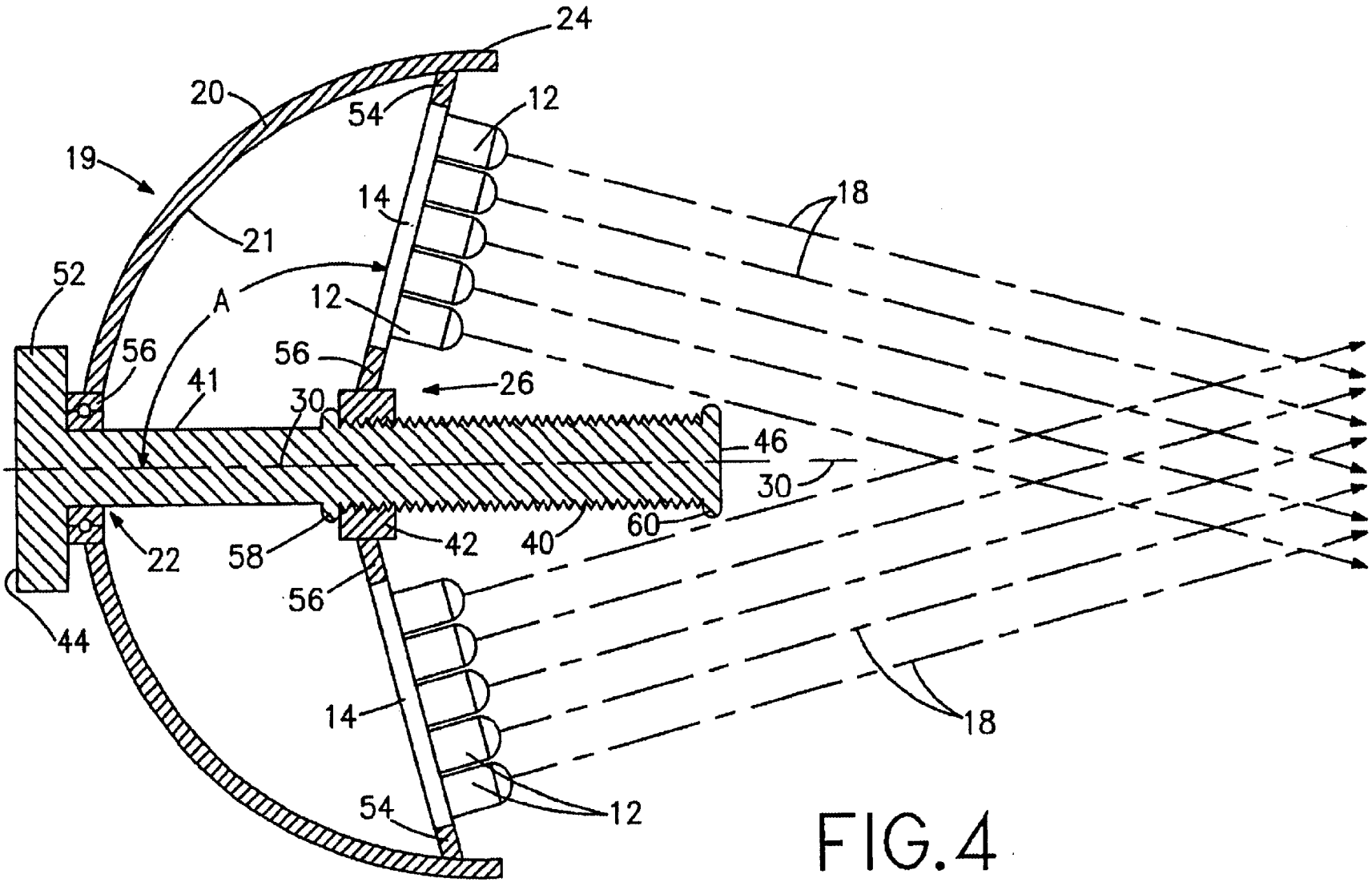
FIG. 4 is a sectional view of the lighting system taken through line 4—4 in FIG. 3 showing the diode light beams in a converging beam mode.

FIGS. 3 and 4 show all diode panels 14 in a selected position wherein diode panels 14 are positioned oriented at a selected common obtuse angle A as measured relative to housing axis 30, that is, to externally threaded cylinder 40, and inner end portion 44 of cylinder 40. In this position diode light beams 18 emanating from diodes 12 positioned on of all diode panels 14 are in a converging mode. The selected converging mode of diode light beams 18 as shown in FIGS. 3 and 4 is at the maximum converging mode of diode light beams 18 wherein cylindrical nut 42 is positioned in contact with a cylindrical internal stop 58 connected to externally threaded cylinder 40 that is spaced from inner end portion 44 of externally threaded cylinder 40 and in particular is located at the inner end of threaded portion 40. Any of a plurality of converging mode orientations of diode light beams 18 can be selected by positioning cylindrical nut 42 at any of a plurality of selected positions between the normal, or parallel light beam mode, of diode light beams 18 as shown in FIG. 2 and the maximum converging mode of diode light beams 18 towards a common focus area as shown in FIG. 4. In the maximum converging mode diode light beams 18 by pass outer end portion 46 of externally threaded cylinder 40.

Figure 5:
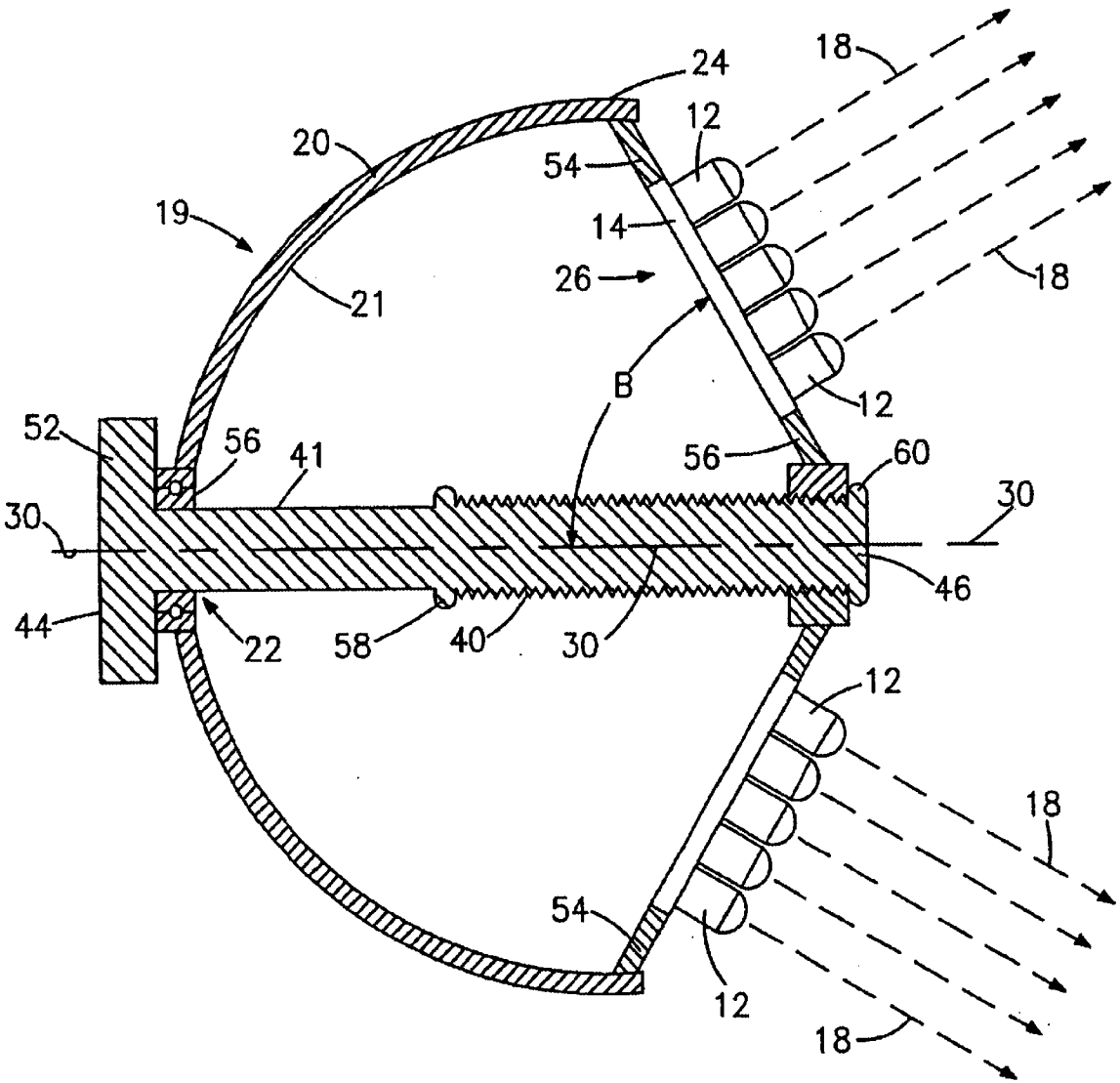
FIG. 5 is a sectional side view of the lighting system analogous to the view shown in FIG. 4 with the diode panels in the rearward mode showing the diode light beams in a diverging mode.

FIG. 5 shows all diode panels 14 in a selected position wherein diode panels 14 are positioned oriented at a selected common acute angle B relative to housing axis 30 as measured relative to housing axis 30, that is, to externally threaded cylinder 40, and inner end portion 44 of threaded cylinder 40. In this position diode light beams 18 emanating from all diodes 14 positioned on diode panels 14 are focused toward a common focus area. In this position diode light beams 18 are in a diverging mode. The selected diverging mode of diode light beams 18 as shown in FIG. 5 is at the maximum diverging mode of diode light beams 18 wherein cylindrical nut 42 is positioned in contact with a cylindrical external stop 60 connected to outer end portion 46 of externally threaded cylinder 40.

Figure 6:
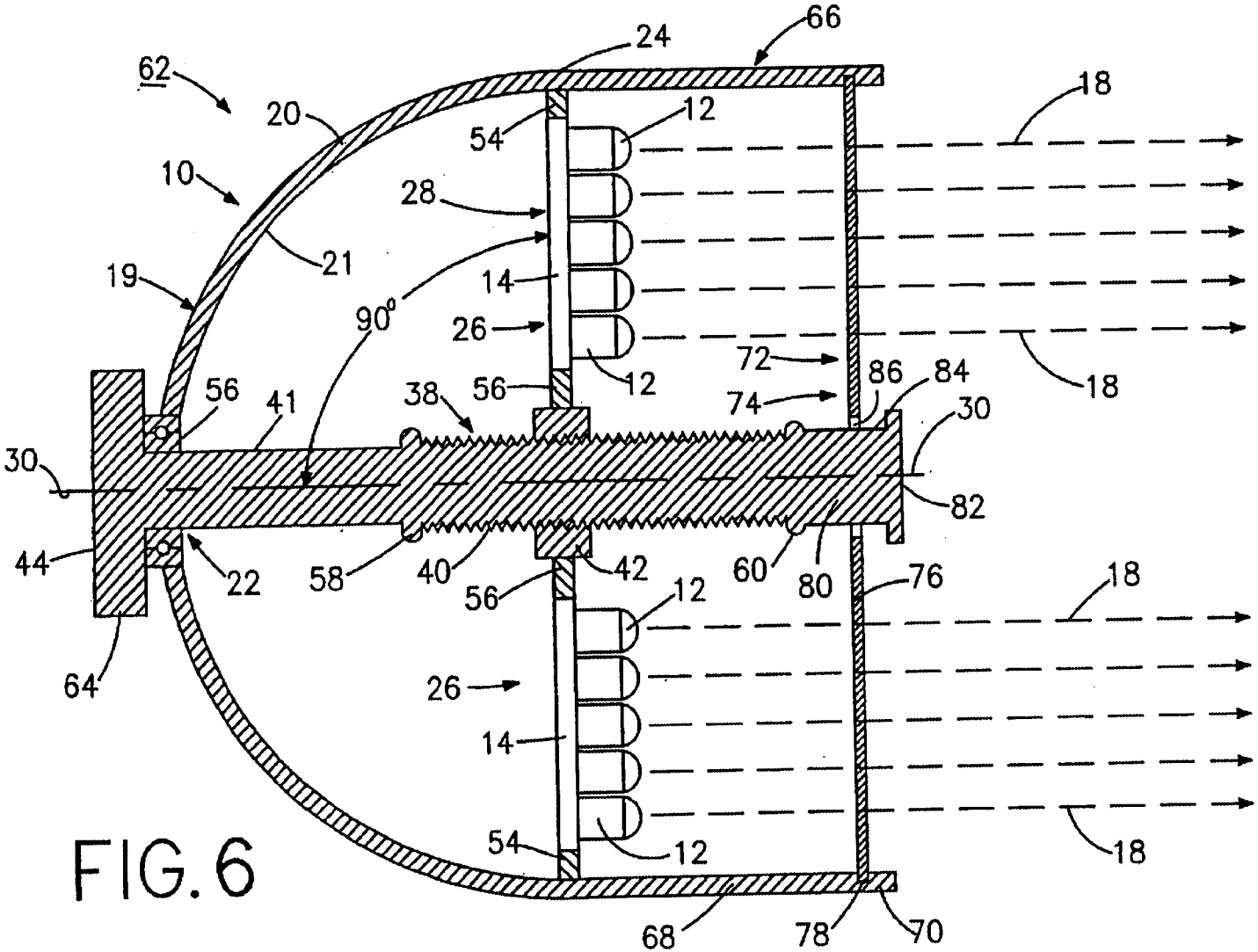
FIG. 6 is a sectional view of another embodiment of the lighting system analogous to the view shown in FIG. 3 with a protective lens positioned across the front of the housing and with a front hand wheel.

FIG. 6 shows a diode lighting system embodiment 62 generally analogous to diode lighting system 10 that includes housing 19 with the circular housing rim 24 defining circular aperture 26 and diodes 12 mounted to eight diode panels 14. Screw arrangement 38 including externally threaded solid cylinder 40 having opposed inner and outer end portions 44 and 46, respectively, and internally threaded cylindrical nut 42 threaded thereto is mounted in housing 19 at inner end portion 44 in alignment with a central housing axis 30. An optional handwheel 64 is positioned external to housing 19 at inner end portion 44. Eight diode panels 14 having diodes 12 mounted thereto are connected to housing 19 at circular housing rim 24 exactly as shown in FIGS. 1 and 2. Flexible internal and outer connecting rings 54 and 56, respectively, connect diode panels 14 to cylindrical nut 42 as shown in FIGS. 1 and 2. Internal and external stops 58 and 60, respectively, are mounted to externally threaded cylinder 40 as described in relation to diode lighting system 10 and as shown in FIGS. 1 and 2.

As shown in FIG. 6, a cylindrical extension member 66 that includes a cylindrical wall 68 is connected to the circular housing rim 24 in axial alignment with housing axis 30 of housing 19. Cylindrical extension member 66 defines an extension member outer circular rim 70 that defines a circular aperture 72 that in turn lies in an extension member rim plane 74 that is perpendicular to housing axis 30. Extension member rim 70 and extension member rim plane 74 are spaced outwardly from outer end portion 46 and from external stop 60. A cylindrical protective lens 76 is mounted to extension member 66 in association with outer rim 70 and plane 74 in perpendicular relationship with housing axis 30. Lens 76 is mounted to outer rim 70 by any suitable means known in the art such as the interior side of rim 70 defining a circular groove 78 into which the circular edge of lens 76 is mounted. A cylindrical axial extension 80 of cylindrical threaded cylinder 40 is connected to outer end portion 46 and extends to an axial extension end 82 that is outwardly spaced from rim plane 74 and lens 76. An outer handwheel 84 is connected to axial extension end 82. Lens 76 defines an axially aligned circular lens aperture 86 that has a lens aperture diameter. Cylindrical axial extension 80 has an axial extension diameter that is less than the diameter of circular lens aperture 86. An operator can rotate outer handwheel 86 in either a clockwise or counterclockwise direction. When handwheel 86 is rotated in a clockwise direction, cylindrical nut 42 is moved axially towards external stop 60 wherein diode panels 14 are moved to the acute angle mode and diode light beams are moved towards the diverging mode shown in FIG. 5. When handwheel 86 is rotated in a counterclockwise direction, cylindrical nut 42 is moved axially towards internal stop 58 wherein diode panels 14 are moved to the obtuse angle mode and diode light beams are moved towards the converging mode shown in FIG. 4. Rotation of outer handwheel 84 in either rotational direction give the operator the option of moving diode panels 14 to any of a plurality of preselected positions.

An alternate embodiment of light source system 10 is light source system 88 shown in FIGS. 7–12. Light source system 88 includes a plurality of light emitting diodes (LEDs) 90, referred to as diodes herein, that are mounted on eight separate flat diode panels 92 so as to emit diode light beams 94 towards a common focus area as seen in one directional mode in FIG. 8. The number of diode panels 92 are shown as eight for purposes of exposition only and can vary in number. A panel diode group 96 includes seventeen diodes 90 per diode panel 92 for a total of 136 diodes for the total array of diodes for light source system 88. The number of diodes 90 per diode panel 92 is shown as seventeen for purposes of exposition only and can vary. Each diode group 96 emits a common group of seventeen diode light beams 94 in parallel relationship.

Figure 7:
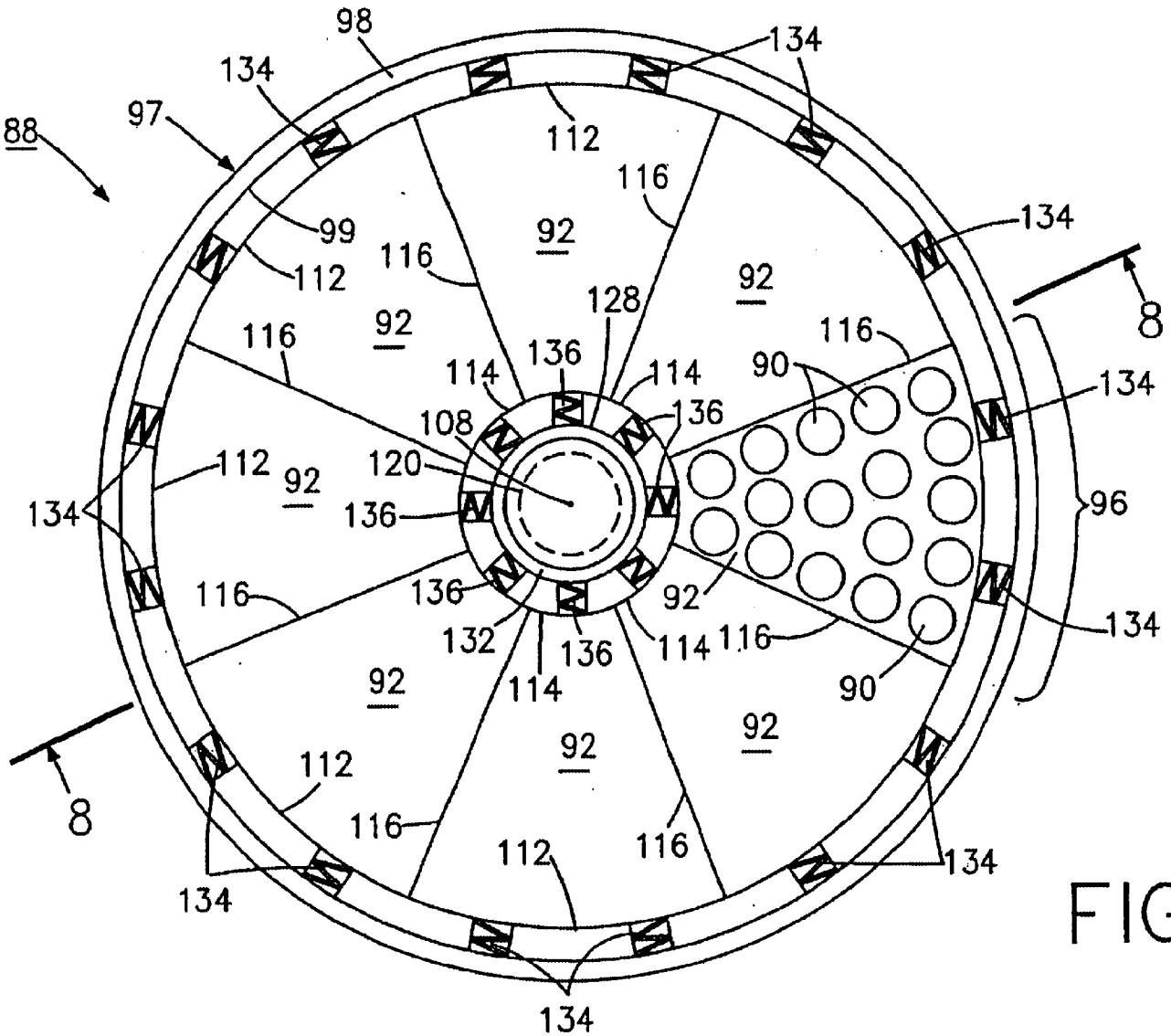
FIG. 7 is a frontal view of another embodiment of the variable beam lighting system that in particular shows a plurality of diodes mounted on eight wedge-shaped mounting board/circuit board diode panels indicating one diode panel with diodes for purposes of convenience in the normal, or parallel beam, mode of the diodes with outer and inner springs connecting the diode panels with both the housing and a center hollow cylinder.
Figure 8:
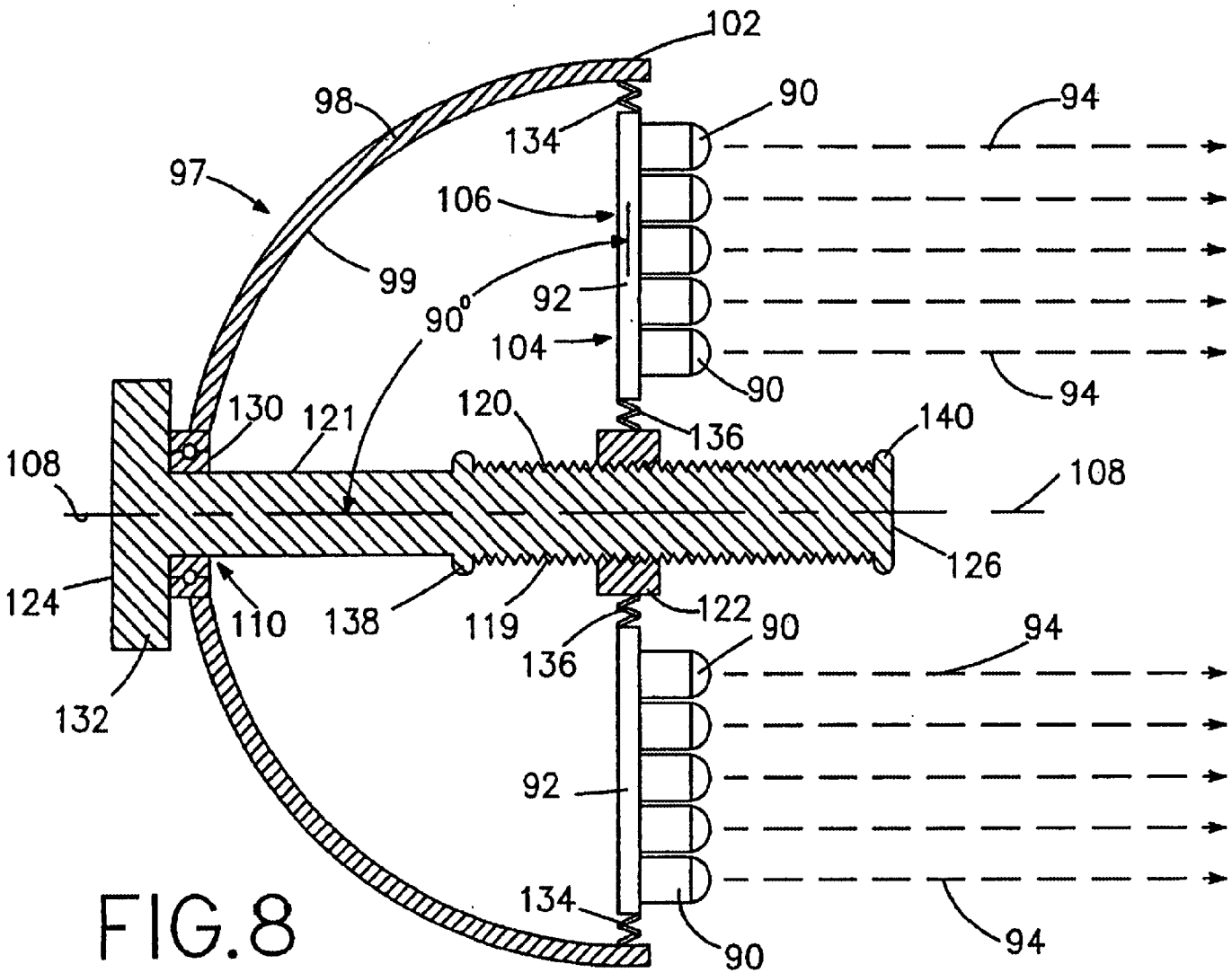
FIG. 8 is a sectional side view of the lighting system taken through line 8—8 of FIG. 7 with the diode panels in the normal position showing the diode light beams in a parallel mode.

FIGS. 7 and 8 show a housing 97 for containing and holding diode panels 92 and diodes 90. Housing 97 defines a concave hollow volume shown as semi-spherical in configuration for purposes of exposition but the configuration of housing 97 is preferably of any regular configuration such as semi-ellipsoidal, cone-shaped, and parabolic. Housing 97 has a housing wall 98 preferably having a microreflective inner surface 99. Housing 97 has a center base portion 100 and a circular rim 102 that in turn defines a circular aperture 104 that lies in a housing aperture plane 106. The center of circular aperture 104 is in an axial alignment indicated in FIG. 8 as axis 108 with center base portion 110. Each separate diode panel 92 is configured as a wedge with a panel outer arc edge 112 and a panel inner arc edge 114 and panel linear side edges 116 that taper inwardly from panel outer arc edge 112 to panel inner arc edge 114. All diode panels 92 are movable relative to one another so that all panel side edges 116 are movable between adjacent panel relationships and separated panel relationships between a plurality of selected positions relative to axis 108 wherein each diode panel 92 is oriented at a predetermined angle relative to axis 108. As a result, each panel diode group 96 emits diode light beams 94 at a beam angle transverse to the predetermined angle of panels 92. A beam direction selection screw mechanism or arrangement 118 is secured to housing 97 and to each diode panel 92 at panel inner arc edge 114.

Screw arrangement 118 positions each diode panel 92 between a plurality of selected positions relative to axis 108 wherein each diode panel 92 is oriented at a predetermined angle relative to axis 108. As a result, each panel diode group 96 emits diode light beams 94 at a beam angle transverse to the predetermined angle of panels 92. Screw arrangement 118 is secured to housing 97 and to each diode panel 92 at panel inner arc edge 114.

Screw arrangement 118 comprises an elongated externally spirally threaded solid cylinder 119 having a threaded portion 120 and an unthreaded portion 121 that extends between center base portion 110 and threaded portion 120 and a correspondingly internally threaded cylindrical nut 122 Externally threaded solid cylinder 119 is threadably mounted within an internally threaded cylindrical nut 122. Externally threaded solid cylinder 119 is rotatably aligned with axis 108 of housing 97 and extends external to housing rim aperture plane 106. Externally threaded cylinder 119 has opposed inner and outer end portions 124 and 126, respectively. Inner end portion 124 is rotatably mounted to housing 97 at center base portion 100. Outer end portion 126 is positioned spaced from housing rim plane 106. Internally threaded cylindrical nut 122 has a cylindrical outer surface 128. Center base portion 100 defines an aperture wherein is mounted bearings 130 through which externally threaded cylinder 119 extends external to housing rim plane 106. A handwheel 132 is mounted to externally threaded solid cylinder 119 external to housing wall 98.

As shown in FIGS. 7–12, diode panels 92 are flexibly and biasedly connected to housing 97. Each panel outer arced edge 114 of each diode panel 92 is connected to housing wall 98 at circular rim 102 by two outer springs 134 that are secured both to each panel outer arc edge 112 and to housing wall 98 at housing rim 102 by a suitable means known in the art, for example by hook and ring. Two outer springs 134 are shown for purposes of exposition only and more that two outer springs 136 can be used.

Also, as shown in FIGS. 7–12, diode panels 92 are flexibly and biasedly connected to cylindrical nut 122 and in particular are connected to outer end portion 126 of externally threaded cylinder 119.

Screw arrangement 118 is operable by rotation of handwheel 132 at inner end portion 124 in either a clockwise or a counterclockwise direction. When handwheel 132 is rotated in the clockwise direction when diode panels 92 are positioned in the housing rim aperture plane 106 shown in FIG. 8, externally threaded solid cylinder 119 rotates clockwise relative to cylindrical nut 122 wherein panel inner edges 114 are drawn inwardly relative to housing rim 102. Continued counterclockwise rotation can continue until cylindrical nut 122 is retrained by an internal cylindrical stop 138 connected to threaded solid cylinder 119 at a position spaced from center base portion 110 in particular at the inner end of threaded portion 121, a position shown in FIG. 10. When handwheel 132 is rotated in the clockwise direction when diode panels 92 are in the position shown in FIG. 8 externally threaded solid cylinder 119 rotates clockwise relative to cylindrical nut 122 so that panel linear side edges 116 are pushed outwardly, or apart, relative to rim 102. Continued counterclockwise rotation will result in cylindrical nut 122 being retrained by an external cylindrical stop 140 positioned at outer end portion 126 of externally threaded cylinder 119, a position shown in FIG. 11.

FIGS. 7 and 8 show all diode panels 92 in a selected position wherein diode panels 92 are aligned with housing rim aperture plane 106 and also are aligned at a 90 degree angle relative to housing axis 108 and to threaded cylinder 119. In this selected position diode light beams 94 of all diode panels 92 are oriented relative to axis 108 wherein the angle of diode panels 92 is a diode panel angle of 90 degrees wherein the direction of diode beams is in a normal beam mode parallel to axis 108 towards a common focus area.

Figure 9:
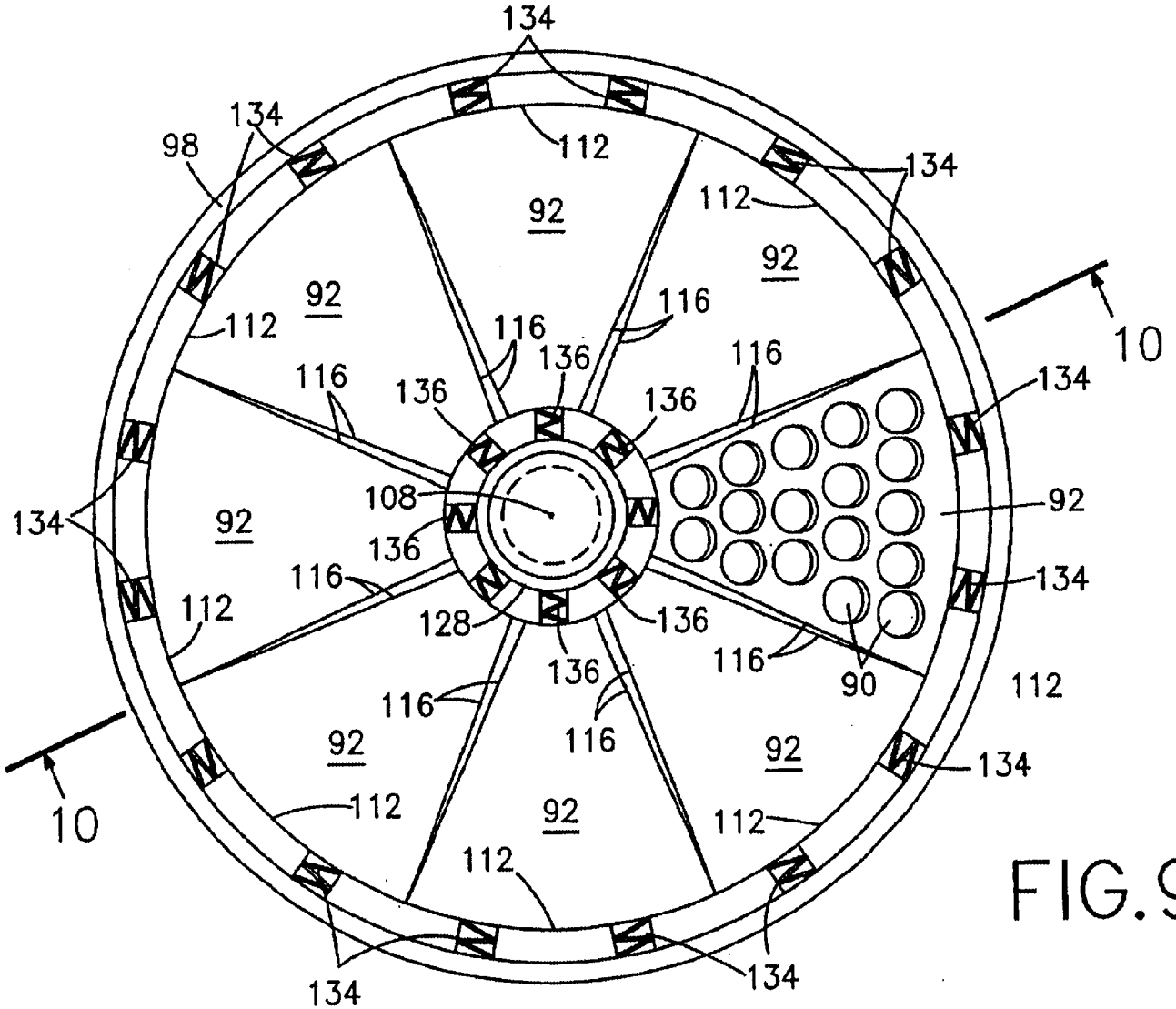
FIG. 9 is a frontal view of the lighting system as shown in FIG. 7 with the eight diode panels in a forward mode with one diode panel shown mounted with diodes for purposes of convenience.
Figure 10:
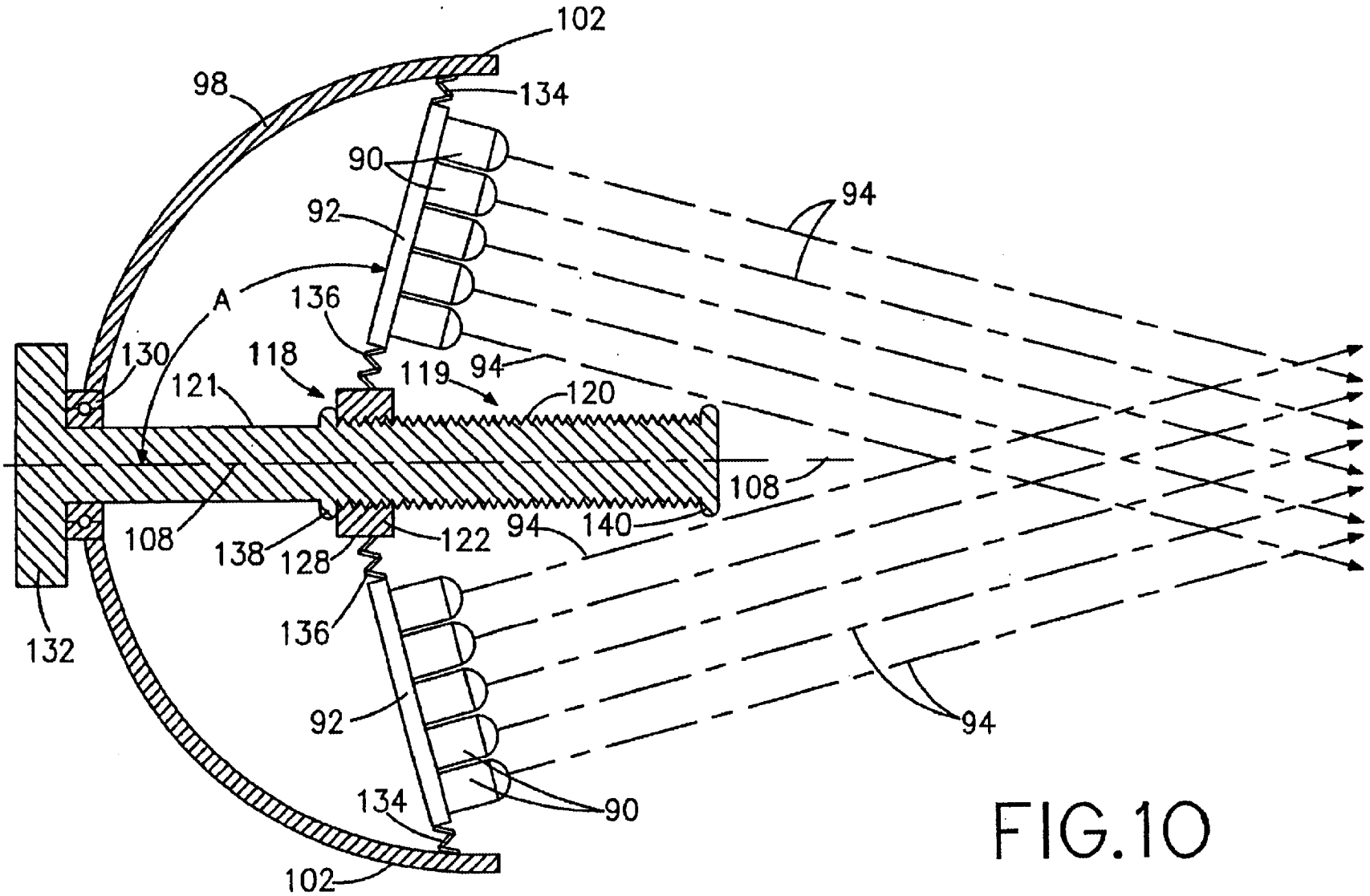
FIG. 10 is a sectional side view taken through line 10—10 in FIG. 9 with the diode panels in rearward mode and showing the diode light beams in a converging mode.

FIGS. 9 and 10 show all diode panels 92 in a selected position wherein diode panels 92 are positioned oriented at a selected common obtuse angle A as measured relative to housing axis 108, that is, to externally threaded cylinder 119, and inner end portion 124 of externally threaded cylinder 119. In this position diode light beams 94 emanating from diodes 90 that are positioned on diode panels 92 are directed to a common focus area in a converging mode. The selected converging mode of diode light beams 94 as shown in FIGS. 9 and 10 is at the maximum converging mode of diode light beams 94 wherein cylindrical nut 122 is positioned in contact with cylindrical internal stop 138 connected to externally threaded cylinder 119. Any of a plurality of converging mode orientations of diode light beams 94 can be selected by positioning cylindrical nut 122 at any of a plurality of selected positions between the normal, or parallel light beam mode, of diode light beams 94 as shown in FIG. 8 and the maximum converging mode of diode light beams 94 shown in FIG. 10. In the maximum converging mode, diode light beams 94 bypass outer end portion 126 of externally threaded cylinder 119 and external stop 140.

Figure 11:
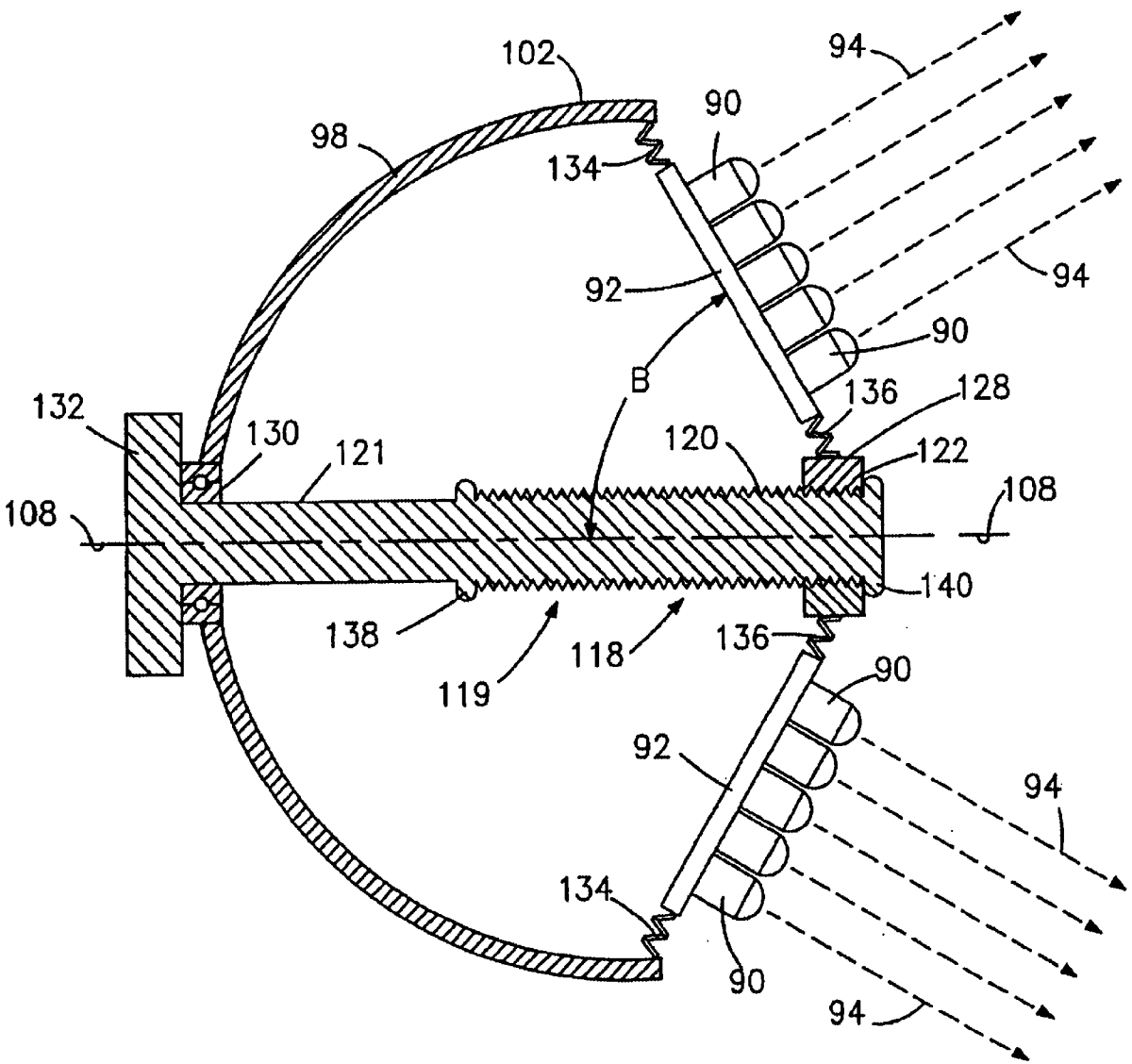
FIG. 11 is a sectional side view of the lighting system analogous of the lighting system as shown in FIG. 7 with the diode panels in the forward mode and the diode light beams in a diverging mode.

FIG. 11 shows all diode panels 92 in a selected position wherein diode panels 92 are positioned oriented at a selected common acute angle B relative to axis 108 as measured relative to housing axis 108, that is, to externally threaded cylinder 119, and inner end portion 124 of externally threaded cylinder 119. In this position diode light beams 94 emanating from all diodes 90 positioned on diode panels 92 are directed towards a common focus area. In this position diode light beams 94 are in a diverging mode. The selected diverging mode of diode light beams 94 as shown in FIG. 11 is at the maximum diverging mode of diode light beams 94 wherein cylindrical nut 122 is positioned in contact with a cylindrical external stop 60.

Figure 12:
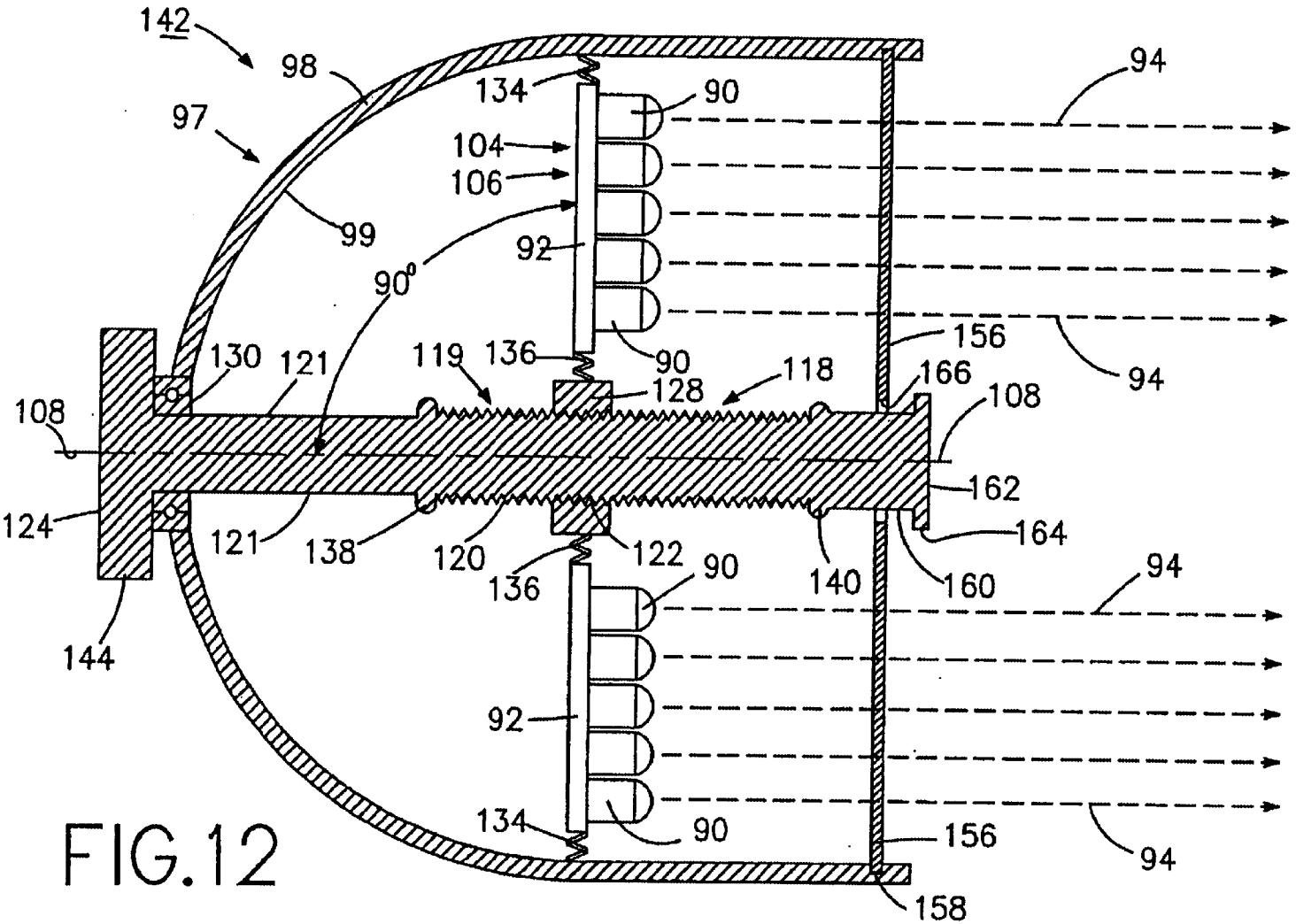
FIG. 12 is a sectional side view of another embodiment of the lighting system analogous to the view shown in FIG. 8 with a protective lens positioned across the front of the housing and a front hand wheel.

FIG. 12 shows a diode lighting system embodiment 142 generally analogous to diode lighting system 88 that includes housing 97 and housing wall 98 with housing rim 106 defining circular aperture 104 lying in a housing rim aperture plane 106 and seventeen diodes 90 mounted to eight diode panels 92. Externally threaded solid cylinder 119 and the center of housing circular aperture 104 are aligned with an axis 108. Screw arrangement 118 including externally threaded solid cylinder 119 having opposed inner and outer end portions 124 and 126, respectively, and internally threaded cylindrical nut 122 threaded thereto is mounted within housing 97 with inner end portion 124 in alignment with central housing axis 108. An optional handwheel 144 is positioned external to housing wall 98 at inner end portion 124. Eight diode panels 92 having diodes 90 mounted thereto are connected to housing 97 at circular rim 102 as shown in FIGS. 7, 8, 9, and 10. An internal cylindrical stop 138 is connected to threaded solid cylinder 119 at a position spaced from inner end portion 124. Also, an external cylindrical stop 140 is connected to threaded solid cylinder 119 at outer end portion 126 of threaded solid cylinder 119.

As discussed previously in relation to FIGS. 7–11, embodiment 142 as shown in FIG. 12 includes eight diode panels 92 are flexibly and biasedly connected to housing 97. Each panel outer arced edge 112 of each diode panel 92 is connected to housing wall 98 at circular rim 102 by two outer springs 134 that are secured both to each panel outer arc edge 112 and to housing wall 98 at housing rim 102 by a suitable means known in the art, for example by hook and ring. Two outer springs 134 are shown for purposes of exposition only and more that two outer springs can be used. Embodiment 142 also shows eight diode panels 92 being flexibly and biasedly connected to cylindrical nut 122. Each panel inner arced edge 114 of each diode panel 92 is connected to cylindrical nut 122 by an inner spring 136. Connection is made by any suitable means known in the art, for example by hook and ring. More than one inner spring 136 can be used.

As shown in FIG. 12, a cylindrical extension member 146 that includes a cylindrical wall 148 is connected to housing rim 106 in axial alignment with axis 108. Cylindrical extension member 146 defines an extension member outer circular rim 150 that defines a circular outer extension aperture 152 that in turn lies in an extension member rim plane 154 that is perpendicular to axis 108. Extension member rim 150 and extension member rim plane 154 are spaced outwardly from outer end portion 126 and external stop 140. A cylindrical protective lens 156 is mounted to extension member 146 in association with outer extension member outer rim 150 and plane 154 in perpendicular relationship with axis 108. Lens 156 is mounted to extension member outer rim 150 by any suitable means known in the art such as the interior side of rim 150 defining a circular groove 158 into which the circular edge of lens 156 is mounted. A cylindrical axial extension 160 of cylindrical threaded cylinder 119 is connected to outer end portion 126 and extends to an axial extension end 162 that is spaced outwardly from extension member rim plane 154 and lens 156. An outer handwheel 164 is connected to axial extension end 162. Lens 156 defines an axially aligned circular lens aperture 166 that has a lens aperture diameter. Cylindrical axial extension 160 has an axial extension diameter that is less than the lens aperture diameter so that cylindrical axial extension 160 passes through lens aperture 166. An operator can rotate outer handwheel 164 in either a clockwise or counterclockwise direction. When outer handwheel 164 is rotated in a clockwise direction, cylindrical nut 122 is moved axially towards external stop 140 to the position shown in FIG. 11 wherein diode panels 92 are moved to the acute angle mode and diode light beams are moved towards the diverging mode shown in FIG. 11. When outer handwheel 164 as shown in FIG. 12 is rotated in a counterclockwise direction, cylindrical nut 122 is moved axially towards internal stop 138 wherein diode panels 92 are moved to the obtuse angle mode and diode light beams are moved towards the converging mode as shown in FIG. 10. Rotation of outer handwheel 164 in either rotational direction gives the operator the option of moving diode panels 92 to any of a plurality of preselected positions.

Light emitting diodes 12 shown in conduction with diode lighting system 10 and likewise light emitting diodes 90 shown in conduction with diode lighting system 88 can be white light emitting diodes. Light emitting diodes 12 and 90 can also be colored light emitting diodes selected from the group consisting of red, green, and blue light emitting diodes. In addition, light emitting diodes can be light emitting diodes selected from the group consisting of cyan, yellow and magenta.

Basic electrical control of light emitting diodes can be accomplished in three different basic electrical structures or configurations that are set forth in FIGS. 30, 31, 32 and 33 as discussed below. Before proceeding with a discussion of these electrical configurations, a basic comment is as follows. A light emitting diode is a special luminescent semiconductor device that when an adequate amount of forward drive current is passed through the diode, a particular color of light is emitted. This forward drive current is typically 20 milliamperes (20 mA) depending on individual light emitting diode characteristics.

In FIGS. 13, 14, 15 and 16 the following is the legend:

~=VAC (Voltage Alternating Current)

V=VDC (Voltage Direct Current)

I=Current

R=Resistance

C=Capacitance

D=Light Emitting Diode

B=Diode Bridge Rectifier

Figure 13:
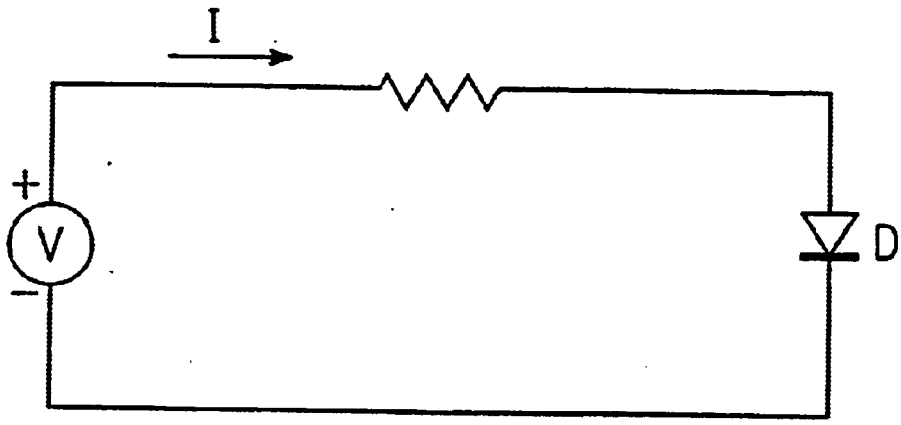
FIG. 13 is a basic electrical diagram that relates to the selection of a single light emitting diode for a given direct current voltage.

FIG. 13 is an electrical diagram that shows the derivation of a forward current I driving a light emitting diode D by dividing the direct current voltage V by the resistor value, or resistance R, that is, $I=V/R$. With a constant voltage value, the resistance R can be selected to produce the necessary forward drive current for light emitting diode D.

Figure 14:
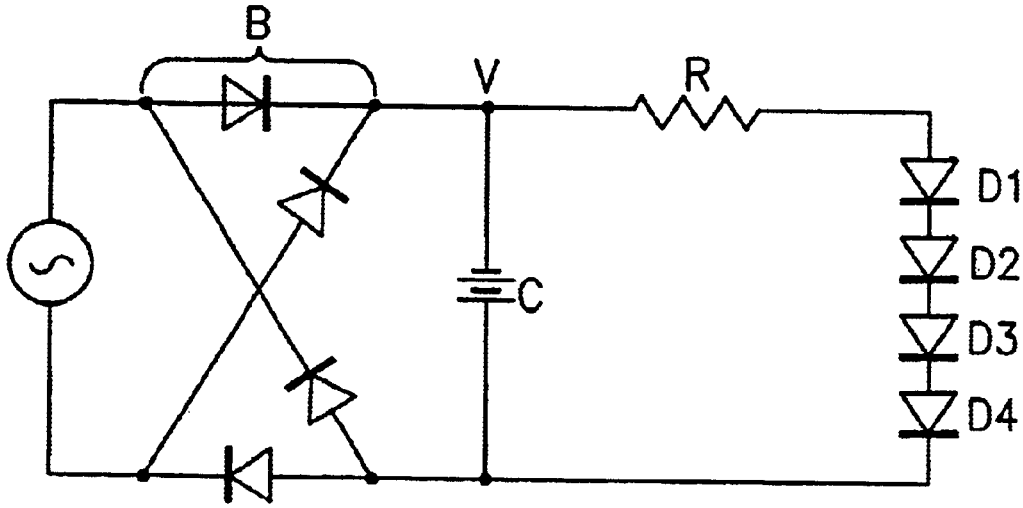
FIG. 14 is a basic electrical diagram that relates to the selection of a plurality of light emitting diodes connected in series in electrical connection with a source of alternating current that has been converted to direct current voltage.

FIG. 14 is an electrical diagram that shows alternating current voltage passing through diode bridge rectifier B and becoming direct current voltage V to drive the light emitting diodes $D_1$, $D_2$, $D_3$ and $D_4$. Resistance R is used to limit the forward drive current I, and the capacitance C is used to smooth out the ripple current of the direct current voltage and make it more constant. The light emitting diodes are connected in series such that the forward drive current is identical in all of the light emitting diodes $D_1$, $D_2$, $D_3$ and $D_4$. Provided that the light emitting diodes $D_1$, $D_2$, $D_3$ and $D_4$ are the same, the actual voltage V divided by the actual number of light emitting diodes in the series, or in this case, V/4.

Figure 15:
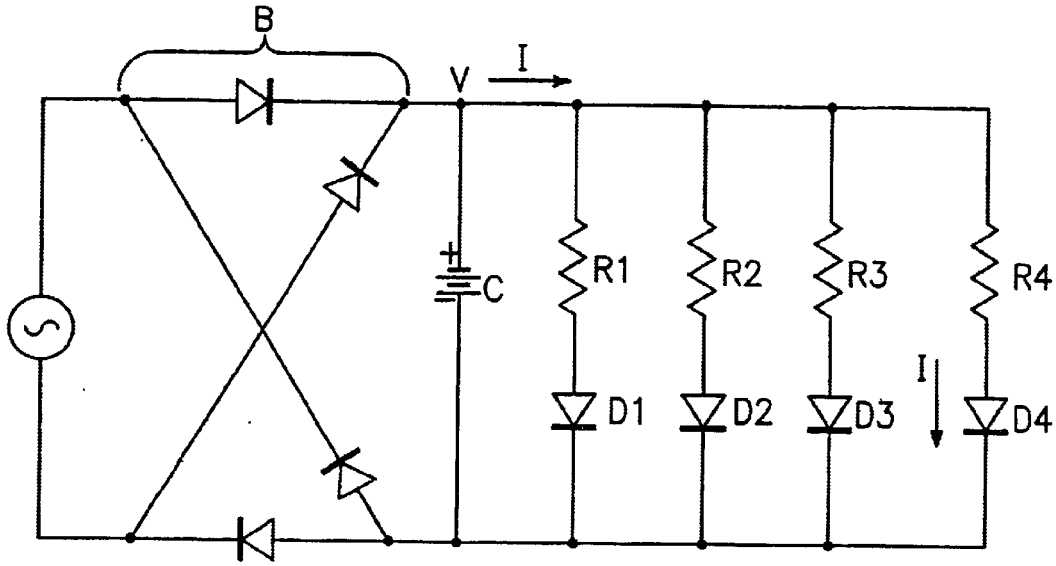
FIG. 15 is a basic electrical diagram that relates to the selection of a plurality of light emitting diodes connected in parallel in electrical connection with a source of alternating current that has been converted to direct current voltage.

FIG. 15 is an electrical diagram that shows light emitting diodes $D_1$, $D_2$, $D_3$ and $D_4$ are now connected in parallel such that each individual light emitting diode receives the same direct current voltage V. The individual forward drive currents are derived as follows for each light emitting diode. For $D_1$ to $D_4$, $I_1=V/R_1$; for $D_2$, $I_2=V/R_2$; for $D_3$, $I_3=V/R_3$; and for $D_4$, $I_4=V/R_4$. The total current $I=I_1+I_2+I_3+I_4$.

Figure 16:
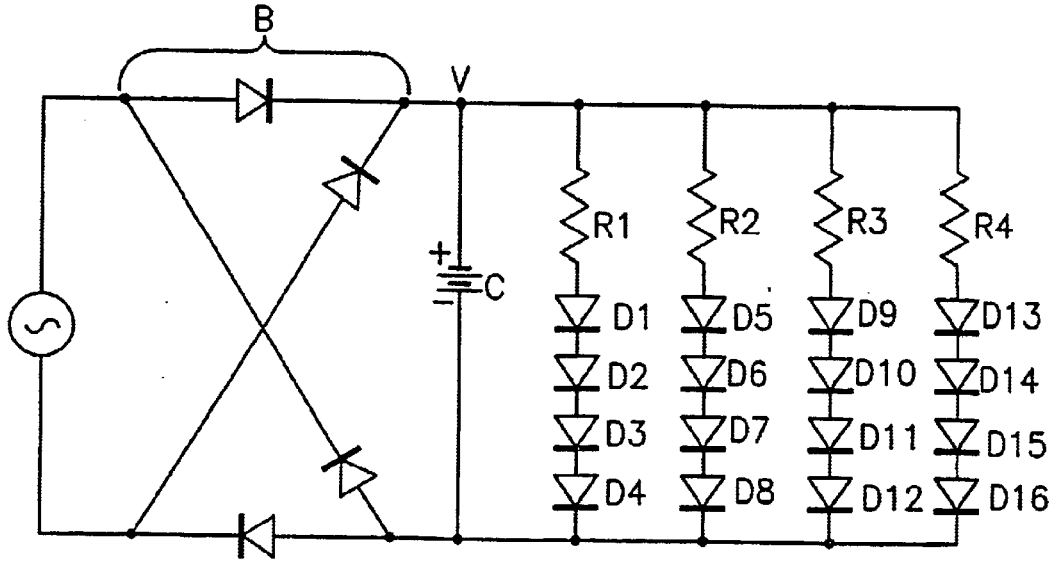
FIG. 16 is a basic electrical diagram that relates to the selection of a plurality of light emitting diodes connected both in series and in parallel in electrical connection with a source of alternating current that has been converted to direct current voltage.

FIG. 16 is an electrical diagram that shows a combination of light emitting diodes connected in both series and parallel. Each series leg is connected in parallel to each other. As in FIG. 15, each series leg sees the same direct current voltage V. The total current $I=I_1+I_2+I_3+I_4$. The individual forward drive currents are derived as follows for each light emitting diode: For $D_1$ to $D_4$, $I_1=V/R_1$; for $D_5$ to $D_8$, $I_2=V/R_2$; for $D_9$ to $D_{12}$, $I_3=V/R_3$; and for $D_{13}$ to $D_{16}$, $I_4=V/R_4$. Each light emitting diode in the individual series leg sees only a quarter of the overall voltage V. alternating current passing through a diode bridge rectifier B and becoming direct current voltage V to drive the light emitting diodes $D_1$, $D_2$, $D_3$ and $D_4$.

Four diodes are shown in each of FIGS. 13, 14, 15 and 16 for purposes of exposition only. More or fewer diodes can be used for each example without altering the fundamental derivations.

Added commentary on FIGS. 13, 14, 15 and 16 follows. A fairly direct relationship exists between the forward drive current versus the relative output luminosity for a light emitting diode. The luminous intensity is normally at its maximum at the rated DC forward drive current operating at an ambient temperature of 25 degrees Celsius. When the drive current is less than the rated forward drive current, the output will be correspondingly lower. The described circuit arrangements, therefore, will cause the light emitting diodes to give out a lower light output when the input alternating current voltage is lowered. This makes the light emitting diodes and the related circuitry ideal replacements for existing incandescent filament lamps, because they can be operated with and be dimmed using conventional SCR type wall dimmers.

Likewise, instead of using a constant voltage source to supply current to a circuit containing light emitting diodes, a pulsed forward current can be used. A pulsed forward drive current, as obtained from pulse width or pulse amplitude modulation circuits with adjustable duty emitting diodes to see more drive current resulting in apparently brighter light outputs. Caution must be used when overdriving the light emitting diodes so as not to overheat the diodes and cause them to burn out prematurely.

Figure 18:
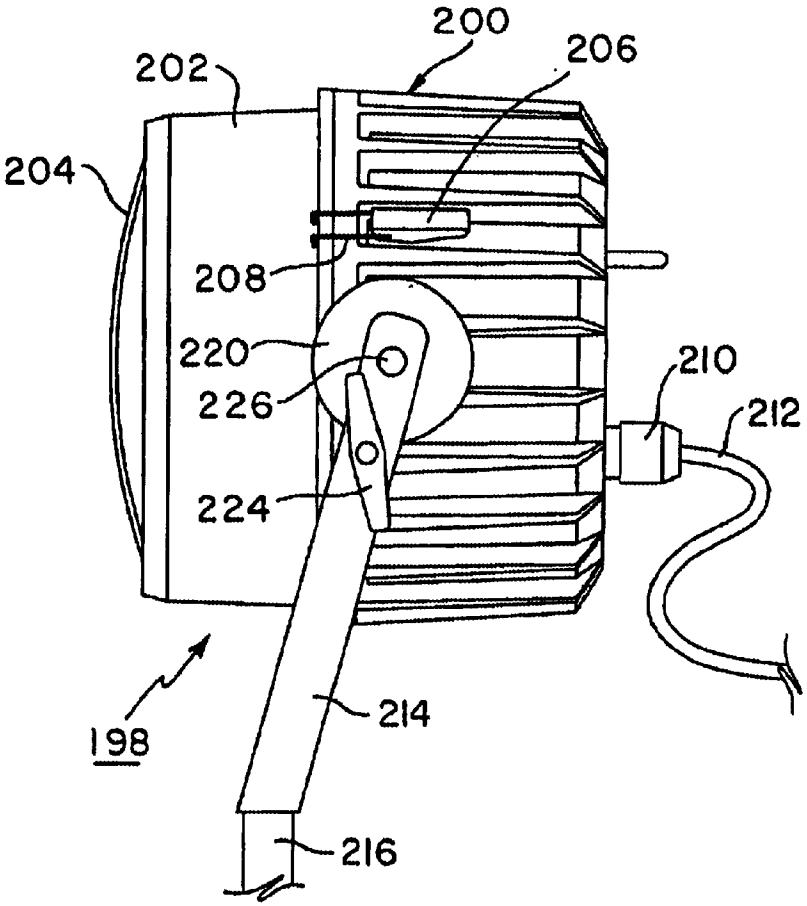
FIGS. 17 and 18 are front and side views, respectively, of an exterior luminaire incorporating the present invention including six rigid panels with (78) LEDs on each panel for a total of (468) LEDs in the luminaire.
Figure 17:
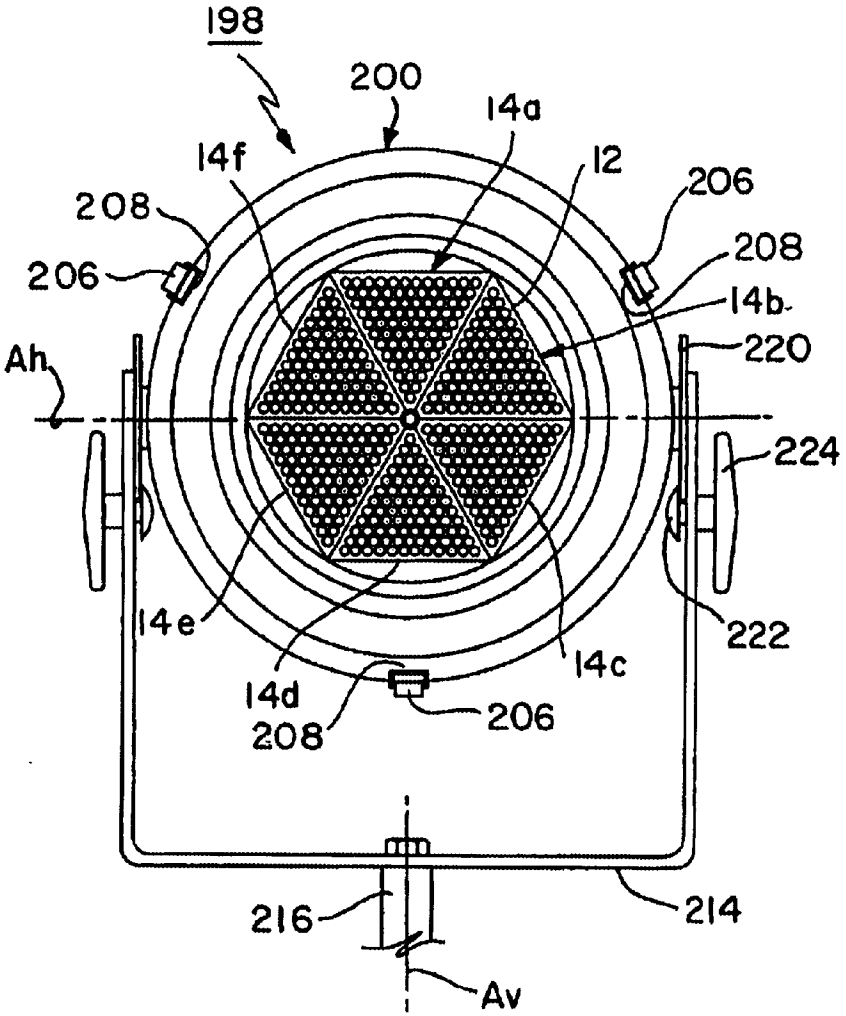

Referring to FIGS. 17 and 18, a luminaire 198 is shown in a front and side view, respectively, that can be used as part of a complete lighting system that provides not only a variable beam, as discussed above, but also provides color changing functionality. The luminaire 198 shown in FIGS. 17 and 18 is intended for outdoor or exterior use and may correspond, for example, to a luminaire manufactured and sold by Altman Stage Lighting, Inc., under its Model No. OUTDOOR-PAR64. Thus, the luminaire 198 includes a housing 200 that can be placed outside and exposed to the elements, and includes a lens barrel 202 containing a weatherproof clear lens cover 204. The barrel 202 is axially secured in press fit relationship against the housing 200, with a seal interposed therebetween in a conventional manner to provide a seal to prevent moisture and water from entering into the housing 200. Conventional retainers 206 are provided with spring clips 208 for maintaining the barrel 202 in press fit relationship against a suitable seal, although removing the clips 208 allows the barrel 202 to be separated from the housing 200 and provides access to the interior of the luminaire.

A conventional connector 210 can be used to secure a power/data cable 212 to the luminaire and the electronics that may be contained therein.

A conventional yoke 214 may be used to support the housing while enabling the housing to rotate about two orthogonal axes, namely, vertical axis Av and horizontal axis Ah. Any suitable mechanism may be used for locking the luminaire against rotation against any one of the aforementioned axes, a disk or plate 220 secured to the housing 200 being shown that can be clamped by a clamping member such as the head of a bolt and that can be tightened by means of finger lug 224. By tightening the lug 224, the head 222 clamps the plate 220 against the yoke 214 to lock it against rotation about the horizontal axis Ah. A similar or another mechanism can be used for locking the yoke against rotation about the vertical axis Av. These features are conventional and do not form part of the invention. However, referring to FIG. 17, a plurality of rigid panels 14*a*–14*f* are shown, each of which supports 78 LEDs for a total of 468 LEDs on the six panels. The specific number of LEDs on each panel and the number of panels are not critical, as indicated in the previous discussion. A motor drive within the housing 200 (not shown on FIGS. 17–18) is arranged to change the angles of the panels in relation to the axis of the housing 200, as described. If desired, a manual hand wheel adjustment (not shown) may be used to augment or supplement the motor drive with a centrally located actuated structure. In this way, the panels 14*a*–14*f* may be adjusted manually in the event of electronic failure and inability to energize the actuator. As in the previously discussed embodiments, the flat rigid panels 14*a*–14*f* are coupled to the fixture housing 200 by resilient means. The actuator structure, motor drive, LED and motor control electronics, fixture addressing and electronics, etc., may all be included within the fixture housing. While FIGS. 17 and 18 suggest that the aforementioned electronics and power units are contained within the housing, it should be evident to those skilled in the art that any or part of such electronic and/or power modules may also be located outside of the housing 200, and it may be advantageous to do so. While maintaining the electronics within the housing has the benefit that the unit is more compact, easier to transport and convenient to use, in some instance it may be beneficial to maintain some or all of these electrical/electronic units outside the housing 200 since this allows one unit to operate or control two or more luminaires and removes heat-generating components from the housing. The advantages and disadvantages, in each case, need to be determined by those skilled in the art in designing these luminaires to satisfy given parameters and design specifications for use in the field.

Figure 20:
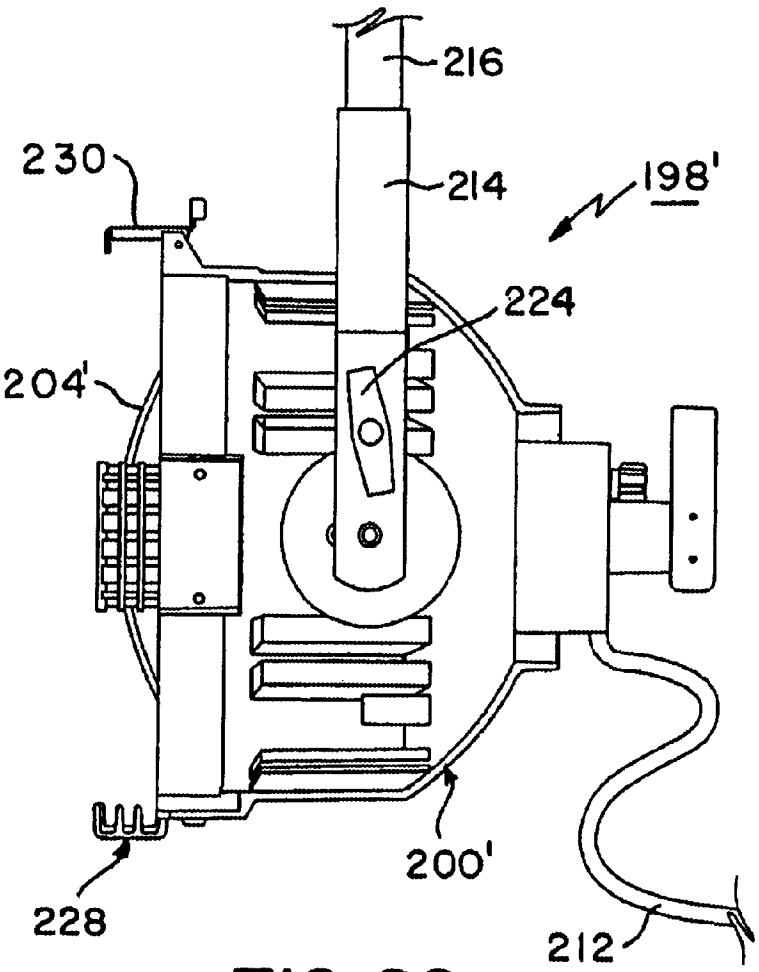
FIGS. 19 and 20 are front and side views of an interior luminaire incorporating the present invention including six rigid panels with (78) LEDs on each panel for a total of (468) LEDs.
Figure 19:
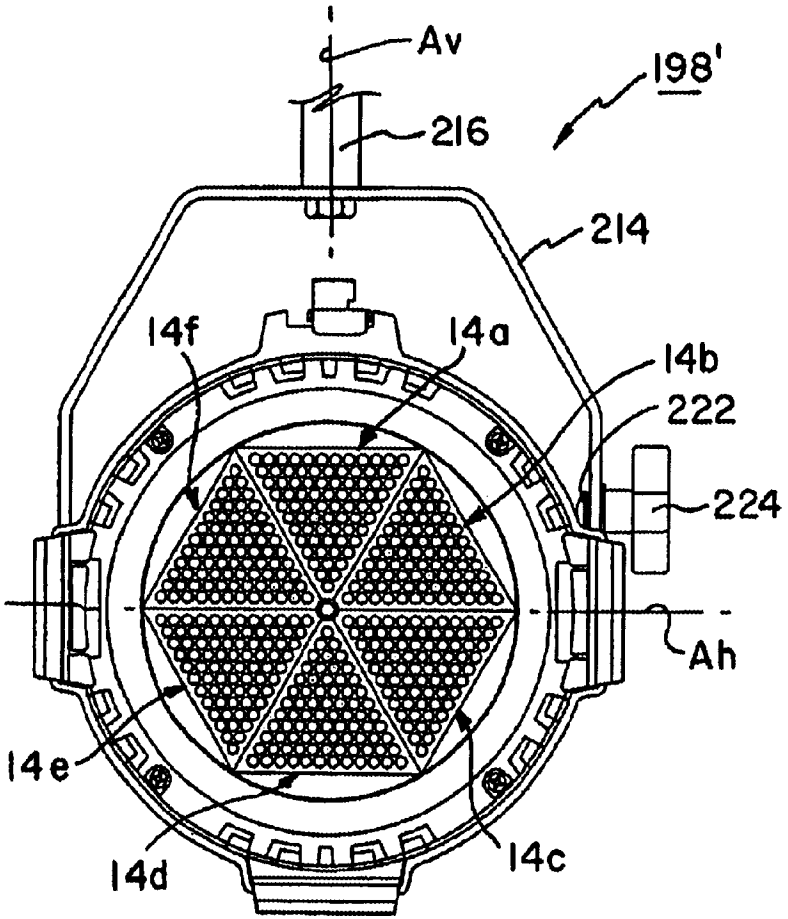

Referring to FIGS. 19 and 20, these figures are similar to FIGS. 17 and 18, except that the luminaire 198' is intended for interior use. Such an indoor luminaire may be similar to the indoor luminaire sold by Altman Stage Lighting Company under the trademark "STAR PAR". It will be noted that the same flat rigid panels 14*a*–14*f* are contained within the housing 200', a shorter clear lens cover 204' being used to protect the LEDs on the interior and to prevent inadvertent injury to personnel that might result from exposure of the LEDs to touch. A conventional retainer support 228 may be used in conjunction with a holding clip or clamp 230 that may be used for supporting various optical components in front of the luminaire, such as color filters, gobos, etc. As in the embodiment 198 shown in FIGS. 17 and 18, a cable 212 is connected to the unit for introducing power and/or digital signals for controlling the colors of the LEDs.

Figure 21:
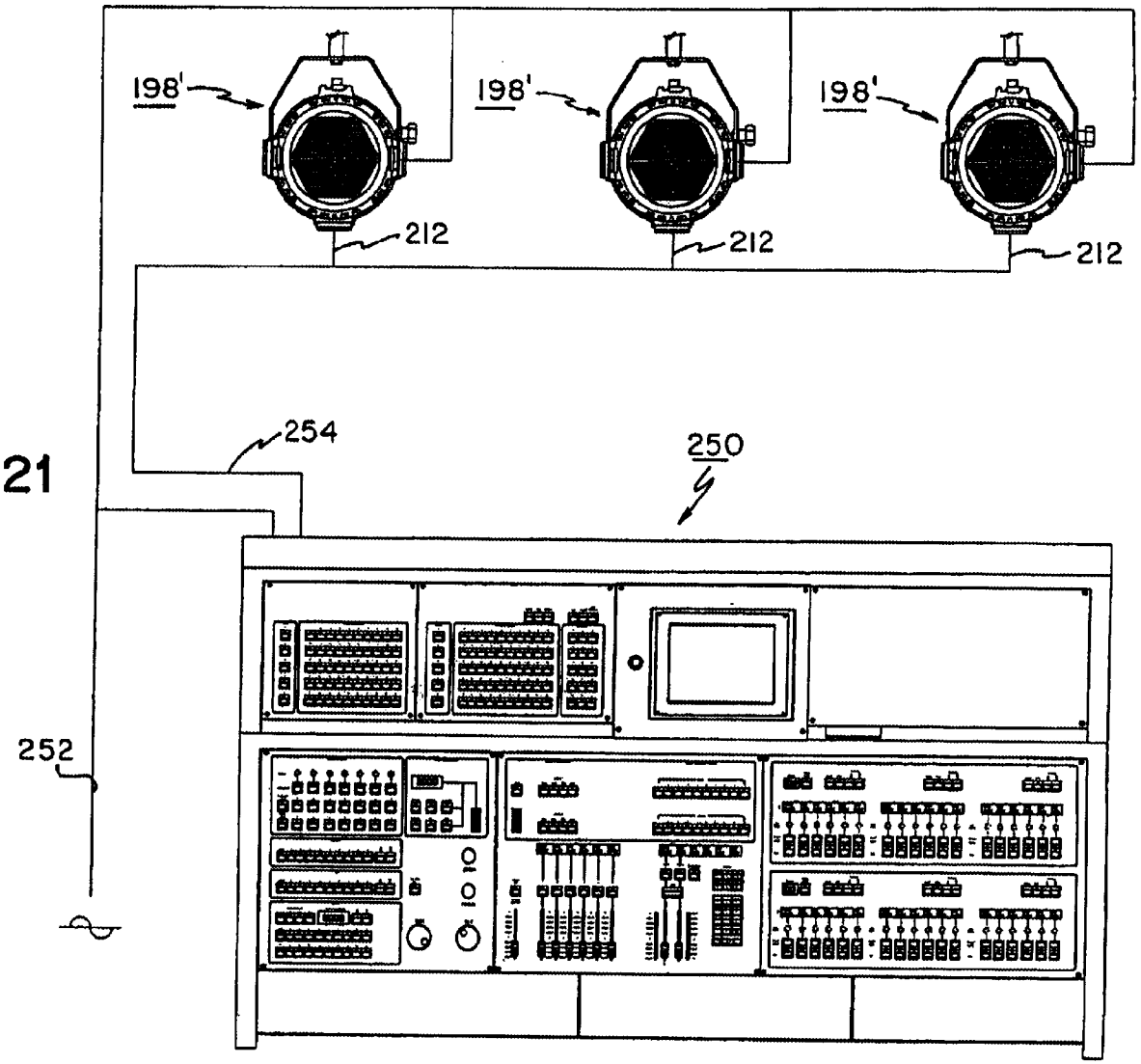
FIG. 21 is a schematic diagram of a variable beam color changing LED lighting system in accordance with the present invention, consisting of a group of luminaires fitted with a cable communications and a power line communications system.

Referring to FIG. 21, an overall lighting system is illustrated for use indoors. Thus, a plurality of indoor luminaires 188' are shown connected to a controller 250 powered by an AC line 252, which is also shown connected to each of the luminaires. The AC power may be converted within the luminaires or, in the alternative, the AC power can be converted remotely from the luminaires and the desired DC power transmitted to each of the luminaires and the desired DC power transmitted to each of the luminaires.

The control unit 250 has an output signal line 254 that is connected to each of the input data lines 212. The internal electronics is more fully disclosed in the following U.S. Pat. Nos.: 4,962,687; 6,016,038; 6,150,774; 6,331,756; 6,331,813; 6,357,983; and 6,459,217.

This internal electronics can communicate with an external controller (not shown) or a remote controller console 250, or can operate independently as a standalone luminaire that can execute internal programs. The specific method of control is not critical, and those skilled in the art are aware of the various methods of controlling luminaires. Some methods of communications with luminaires or linking same to control signals include DMX, DMX512, RS232, X10, and RF and IR wireless control. Other methods of controlling the current in the LEDs, besides DC voltage, include PWM, PAM and CEBus Standard EIA-600.

It will be appreciated that the use of colored LEDs include RGB and CYM for color changing and mixing. An important feature of the present invention is, however, the combining of such colored LEDs with variable beam control to provide a total lighting system of variable beam color changing luminaires. The present invention, therefore, allows both the color and beam angle to be automatically, simultaneously and conveniently controlled by means of electronics or programming, this being done at minimum cost, expense and inconvenience. The system, therefore, performs all of the functions conventionally required of such a system by means of a simple and inexpensive modification to heretofore known color changing systems.

The LEDs described herein can be such that produce white light. Colored LEDs can also be used to produce the primary colors red, green, and blue and also yellow and amber/orange. The LEDs described herein also can be multi-chip and multi-LED arrays. Furthermore the LEDs described herein can be infrared.

Although the present invention has been described in some detail by way of illustration and example for purposes of clarity and understanding, it will, of course, be understood that various changes and modifications may be made in the form, details, and arrangements of the parts without departing from the scope of the invention set forth in the following claims.

What is claimed is:

1. A diode light source system for stage, theatrical and architectural lighting, comprising a plurality of separate flat panels for mounting a plurality of light emitting diodes that emit a plurality of diode light beams to a common focus area, each said separate panel being mounted with a plurality of grouped diodes of said plurality of diodes, each said separate panel having an outer panel portion and an inner panel portion, a housing for containing said panels, said housing having a center base portion and a circular rim defining a housing aperture aligned with a circular rim plane having a rim plane center arranged transverse to an axis aligned with said center base portion, first connecting means for flexibly securing each said outer diode panel portion to said rim, a screw arrangement for positioning said panels at a plurality of selected positions wherein each of said panels is oriented at a selected angle relative to said axis and said grouped diodes emit diode light beams transverse to each said separate panel, second connecting means for flexibly securing each said inner panel portion to said screw arrangement, and electrical circuit means associated with said panels for transmitting and controlling direct current electrical voltage to said plurality of diodes.

2. The diode light source system in accordance with claim 1, further including connecting means for holding said plurality of light emitting diodes to said plurality of separate flat diode panels.

3. The diode light source system in accordance with claim 1, wherein said light emitting diodes are white light emitting diodes.

4. The diode light source system in accordance with claim 1, wherein said adjustable positioning means comprises a screw arrangement.

5. The diode light source system in accordance with claim 1, wherein said light source system comprises a stand-alone luminaire programmed to execute internal programs.

6. The diode light source system in accordance with claim 1, wherein said electrical signals include PWM.

7. The diode light source system in accordance with claim 1, wherein said electrical signals include PAM.

8. The diode light source system in accordance with claim 1, wherein said housing defines a concave hollow volume having an inner surface symmetrical with said axis and with said separate diode panels and with each of said plurality of said grouped diodes at each of said plurality of selected positions.

9. The diode light source system in accordance with claim 8, wherein said inner surface is a microreflective surface.

10. The diode light source system in accordance with claim 1, wherein each of said plurality of separate flat diode panels is unitary with an electrical circuit board.

11. The diode light source system in accordance with claim 10, wherein said circuit boards are rigid circuit boards.

12. The diode light source system in accordance with claim 1, wherein said housing defines a concave hollow volume having an inner surface symmetrical with said axis.

13. The diode light source system in accordance with claim 12, wherein said inner surface is a microreflector surface.

14. The diode light source system in accordance with claim 1, wherein said first connecting means is at least one outer spring.

15. The diode light source system in accordance with claim 14 wherein said connecting means is a plurality of outer springs.

16. The diode light source system in accordance with claim 14, wherein said plurality of outer springs is a plurality of outer coil springs.

17. The diode light source system in accordance with claim 1, wherein said light emitting diodes are colored light emitting diodes.

18. The diode light source system in accordance with claim 17, wherein said colored light emitting diodes are colored light emitting diodes selected from the group consisting of red, green, and blue light emitting diodes.

19. The diode light source system in accordance with claim 17, wherein said colored light emitting diodes are colored light emitting diodes selected from the group consisting of cyan, yellow and magenta light emitting diodes.

20. The diode light source system in accordance with claim 1, wherein three groups of differently colored lights are provided.

21. The diode light source system in accordance with claim 20, wherein the three colors are red, green and blue.

22. The diode light source system in accordance with claim 20, wherein the three colors are cyan, yellow and magenta.

23. The diode light source system in accordance with claim 1, wherein said electrical circuit means includes power and signal modules.

24. The diode light source system in accordance with claim 23, wherein at least one of said modules are contained within said housing.

25. The diode light source system in accordance with claim 23, wherein at least one of said modules are contained remotely from said housing.

26. The diode light source system in accordance with claim 1, wherein said first connecting means is a flexible outer connecting member having a cylindrical configuration.

27. The diode light source system in accordance with claim 26, wherein said flexible outer connecting member is biasable.

28. The diode light source system in accordance with claim 27, wherein said flexible outer connecting member is creased to fold between a normal position in accordance with said normal mode of said panels and expanded position in accordance with said acute angle mode of said panels and with said obtuse angle mode of said panels.

29. The diode light source system in accordance with claim 1, wherein said second connecting means is a flexible inner connecting member having a cylindrical configuration.

30. The diode light source system in accordance with claim 29, wherein said flexible inner connecting member is biasable.

31. The diode light source system in accordance with claim 30, wherein said flexible inner connecting member is creased to fold between a normal position in accordance with said normal mode of said panels and expanded position in accordance with said acute angle mode of said panels and with said obtuse angle mode of said panels.

32. The diode light source system in accordance with claim 1, wherein said second connecting means is at least one inner spring.

33. The diode light source system in accordance with claim 32, wherein said at least one inner spring is a plurality of inner springs.

34. The diode light source system in accordance with claim 33, wherein said plurality of inner springs is a plurality of inner coil springs.

35. The diode light source system in accordance with claim 1, wherein each said panel is a combined mounting board for holding said group of diodes and an electrical circuit board.

36. The diode light source system in accordance with claim 35, wherein each said panel has opposed flat sides, one side functioning as said mounting board and the opposed side functioning as said circuit board having electrical circuitry for operating said group of diodes.

37. The diode light source system in accordance with claim 36, wherein said combination mounting board and circuit board is rigid.

38. The diode light source system in accordance with claim 1, wherein said light source system comprises a plurality of luminaires, said electrical circuit means including linking means for linking control signals to said luminaires.

39. The diode light source system in accordance with claim 38, wherein said linking means comprises hard wire cables.

40. The diode light source system in accordance with claim 38, wherein said linking means includes wireless control.

41. The diode light source system in accordance with claim 38, wherein said linking means includes RF transmission.

42. The diode light source system in accordance with claim 38, wherein said linking means includes IR transmission.

43. The diode light source system in accordance with claim 38, wherein said linking means includes DMX512 control.

44. The diode light source system in accordance with claim 38, wherein said linking means includes RS232 transmission.

45. The diode light source system in accordance with claim 38, wherein said linking means includes x10 control.

46. The diode light source system in accordance with claim 38, wherein said linking means includes CEBus Standard EIA-600.

47. The diode light source system in accordance with claim 1, wherein said screw arrangement comprises an elongated externally threaded cylinder and a correspondingly internally threaded cylindrical nut, said externally threaded cylinder being threadably mounted within said cylindrical nut, said externally threaded cylinder being aligned with said axis, said externally threaded cylinder having opposed inner and outer end portions, said inner end portion being rotatably mounted to said housing at said center base portion and said outer end being spaced outwardly from said circular rim plane, said externally threaded cylinder being aligned with and rotatable about said axis.

48. The diode light source system in accordance with claim 47, wherein said second connecting means flexibly secures each of said inner panel portions to said cylindrical nut.

49. The diode light source system in accordance with claim 47, wherein said inner end portion of said externally threaded cylinder is positioned external to said housing at said center base portion, and further including a handwheel connected to said inner end portion.

50. The diode light source system in accordance with claim 47, further including an outer stop member connected to said outer end portion of said externally threaded cylinder.

51. The diode light source system in accordance with claim 47, further including an inner stop member connected to said externally threaded cylinder spaced from said inner end portion.

52. The diode light source system in accordance with claim 47, further including a cylindrical housing extension member connected to said housing rim portion and extending in alignment with said axis and having an extension member circular rim spaced from said housing rim, said extension member circular rim defining an extension member aperture having an extension member aperture plane transverse to said axis and further including a lens having a lens rim connected to said extension member circular rim and positioned in said extension member aperture plane.

53. The diode light source system in accordance with claim 52, wherein said externally threaded cylinder includes a cylindrical extension member aligned with said axis and extending outwardly from said outer end portion, said lens defining a central circular aperture aligned with said axis, said cylindrical extension member being positioned in said circular aperture and having a cylindrical extension member end spaced outwardly from said lens.

54. The diode light source system in accordance with claim 53, further including an extension member handwheel connected to said cylindrical extension member end.

55. The diode light source system in accordance with claim 47, wherein said panels are of equal size and configuration.

56. The diode light source system in accordance with claim 55, wherein each of said panels is generally configured as a wedge.

57. The diode light source system in accordance with claim 56, wherein each said outer portion of said panels is shaped as a panel outer arc and said housing has an arced inner surface, said panel outer arc being conformed with said housing arced inner surface.

58. The diode light source system in accordance with claim 56, wherein each said inner portion of said panels is shaped as a panel inner arc and said cylindrical nut has an arced outer surface, said panel inner arc being conformed with said arced outer surface of said cylindrical nut.

59. The diode light source system in accordance with claim 47, wherein said plurality of diodes are oriented perpendicular to said flat panels and emit said diode light beams perpendicular to said flat panels.

60. The diode light source system in accordance with claim 59, wherein said flat panels are rigid.

61. The diode light source system in accordance with claim 60, wherein in one of said plurality of selected positions, said panels are oriented in a normal panel mode at a 90 degree angle relative to said axis and said diode light beams are oriented parallel relative to said axis wherein said diode light beams are in a normal beam mode.

62. The diode light source system in accordance with claim 60, wherein in one of said plurality of said selected positions, said panels are oriented at a selected common obtuse angle mode relative to said axis wherein said diode light beams are in a converging mode.

63. The diode light source system in accordance with claim 60, wherein in one of said plurality of said selected positions, said panels are oriented at a selected common acute angle mode relative to said axis wherein said diode light beams are in a diverging mode.

* * * * *